US007063143B2

(12) United States Patent
Tilton et al.

(10) Patent No.: US 7,063,143 B2
(45) Date of Patent: Jun. 20, 2006

(54) DOCKING STATION ASSEMBLY AND METHODS FOR USE IN A WELLBORE

(75) Inventors: Frederick T. Tilton, Spring, TX (US); Charles G. Brunet, Houston, TX (US); David M. Haugen, League City, TX (US); Michel Bouchard, Rio de Janeiro (BR); Clayton Plucheck, Tomball, TX (US); Doug Durst, Katy, TX (US); David J. Brunnert, Houston, TX (US); Clark Robison, Tomball, TX (US)

(73) Assignee: Weatherford/Lamb. Inc., Houston, TX (US)

( * ) Notice: Subject to any disclaimer, the term of this patent is extended or adjusted under 35 U.S.C. 154(b) by 702 days.

(21) Appl. No.: 10/013,189

(22) Filed: Nov. 5, 2001

(65) Prior Publication Data

US 2003/0085815 A1 May 8, 2003

(51) Int. Cl.
*E21B 23/03* (2006.01)

(52) U.S. Cl. ..... 166/242.6; 166/65.1; 166/255.2; 166/117.6; 166/50

(58) Field of Classification Search ..... 166/242.6, 166/65.1, 255.2, 255.3, 117.6, 50
See application file for complete search history.

(56) References Cited

U.S. PATENT DOCUMENTS

| | | | | |
|---|---|---|---|---|
| 3,939,705 A | | 2/1976 | Glotin et al. | 73/151 |
| 4,154,303 A | | 5/1979 | Fournier | 166/317 |
| 5,145,007 A | * | 9/1992 | Dinkins | 166/386 |
| 5,355,952 A | * | 10/1994 | Meynier | 166/250.01 |
| 5,831,156 A | * | 11/1998 | Mullins | 73/152.18 |
| 5,960,883 A | | 10/1999 | Tubel et al. | 166/313 |
| 6,092,416 A | * | 7/2000 | Halford et al. | 73/152.23 |
| 6,315,054 B1 | | 11/2001 | Brunet | 166/387 |
| 6,429,784 B1 | * | 8/2002 | Beique et al. | 340/853.2 |
| 6,668,921 B1 | * | 12/2003 | Koehler et al. | 166/242.2 |
| 6,684,952 B1 | * | 2/2004 | Brockman et al. | 166/250.03 |
| 2001/0025710 A1 | | 10/2001 | Ohmer et al. | 166/313 |

FOREIGN PATENT DOCUMENTS

| | | |
|---|---|---|
| CA | 2372287 | 2/2002 |
| WO | WO 99/02819 | 1/1999 |
| WO | WO 01/29362 A1 | 4/2001 |
| WO | WO 01/42622 A1 | 6/2001 |
| WO | WO 01/65061 A1 | 9/2001 |

OTHER PUBLICATIONS

International Search Report, International Application No. PCT/GB 02/04996, dated Feb. 13, 2003.

* cited by examiner

*Primary Examiner*—Kenneth Thompson
(74) *Attorney, Agent, or Firm*—Patterson & Sheridan, LLP

(57) ABSTRACT

The present invention provides apparatus and methods for controlling and/or powering downhole components without the need for control and/or power lines extending from the components to the surface of the well and without the need for power or control lines to be inserted into the wellbore along with the components. In one aspect of the invention, a borehole is lined with a casing, the casing having at least one aperture disposed. Adjacent the aperture, on the outer surface of the casing, is a docking station, which is permanently attached to the casing and includes a socket. After the casing is installed in the borehole, a downhole component can be lowered into the wellbore. The downhole component is equipped with a connector extending from an outer surface thereof. The connector assembly is disposable through the aperture in the casing and, the connector assembly can be connected to the socket of docking station.

41 Claims, 31 Drawing Sheets

DOCKING STATION ASSEMBLY AND METHODS FOR USE IN A WELLBORE

BACKGROUND OF THE INVENTION

1. Field of the Invention

The present invention relates to well completions. More particularly, the present invention relates to supplying power and/or control to downhole components in a wellbore. More particularly still, the present invention relates to the placement of a power/control source in a wellbore on a first tubular 2. Background of the Related Art In the drilling, completion and operation of hydrocarbon wells, components are routinely inserted into a wellbore and then remotely operated from the surface of the well. Some of the components remain in the wellbore and others are removed after their use often times, multiple components are simultaneously in use in a wellbore. Components include valves, sensors, flow control devices, diagnostic equipment, indexers, seismic devices, downhole pumps, tractors, multiplexers, expander tools and cutting tools, to name a few. All of the foregoing are typically run into the wellbore on a string of tubulars. Additionally, all of the foregoing may rely upon either electrical or fluid power for at least some part of their operation.

Valve-type components used and operated remotely in a wellbore include deployment valves, which are one-way, flapper valves designed to prevent the upward movement of fluids in a wellbore towards the surface of the well. Auto-fill float valves are installed at the lower end of a tubular string as it is inserted into a newly formed borehole. They typically include a valve to permit fluid to enter the string as it is inserted into the wellbore but to later prevent the flow of cement into the string after the cement has been pumped out of the bottom of the string and into an annular area created between the outside surface of the string and the borehole therearound. Another downhole valve is designed to control the flow of fluid into production tubing at a junction between a central wellbore and at least one lateral wellbore extending therefrom. Still other downhole valves include sliding sleeve arrangements wherein ports in a valve body and/or a sleeve are selectively exposed or covered to restrict the flow of fluid through the valve.

Sensors and monitors used downhole include devices to measure well parameters at specific locations in the wellbore. The parameters can include temperature, pressure, flow rate, and other characteristics of the well, the reservoir or the fluids in the reservoir. Sensing components used in a wellbore include devices or sensors to obtain information related to seismic activity at various places in the wellbore. The data is subsequently relayed to the surface of the well. Additionally, diagnostic functions in a wellbore are performed by devices placed in the wellbore which can be electrically connected to another component to diagnose and identify any problems associated with that component in the wellbore.

Other valves used in wellbores are for gas lift operations where gas is injected from the surface of the well through a casing annulus into production tubing through a valve mechanism located above the bottom of the tubing. The gas mixes with production fluids and lightens the flow stream, thereby assisting in bringing production fluids to the surface. Yet another type of valve used in a wellbore relates to the injection of chemicals or other fluids used to treat the wellbore or the surrounding hydrocarbon-bearing formations.

Other downhole components which are controlled from the surface of the well are mechanical in nature and include index tool guides with a shiftable member that shifts from a first position in axial alignment with the center line of the tool body to a second position in which the member is at an angle to the axial centerline of the tool body. The device is run into the wellbore on a tubular and then is remotely actuated to cause the member to assume the second, non-axial position. Yet another example of a mechanical device is a controllable profile. Profiles are routinely used on the inner surface of a tubular to be later engaged by a mating profile inserted into the tubular. The profiles are especially useful in locating and fixing a component in a wellbore at a predetermined, desired location. Controllable profiles are those with shapes that can be changed based upon a signal or manipulation from the surface of the well. Controllable profiles are especially useful to accommodate different tools that might be inserted into the wellbore. Typically, the profiles are changed using wireline, hydraulics or electrical power.

Other downhole devices are used for axial motion in the wellbore. For example, tractors provide axial movement to wellbore components and tubulars when gravity alone is insufficient or when movement cannot be imported from the surface of the well. For example, a tractor is especially useful when an upwards motion must be produced or when a string of tubulars or a component must be moved in a horizontal or lateral wellbore. The tractors typically operate from a source of pressurized fluid supplied from the surface of the well. Similarly, expander tools now exist which can be run into a wellbore on tubing and then, through the use of pressurized fluid, can expand the inner and outer diameter of a tubular therearound pasts its elastic limit. The expander tools use radial extendable rolling members having a piston surface acted upon by pressurized fluid delivered from a tubular string.

Because wellbores may be thousands of feet deep and because lateral and horizontal wellbores are common in today's hydrocarbon wells, components are routinely needed at remote locations in a wellbore. Because the components must be powered, operated and/or monitored from the surface of the well, power lines and/or control lines must extend back to the surface of the well, typically in the interior the tubular transporting the component. In addition to the expense of the lines themselves, the number and sheer length of the control and power lines creates problems with their use. The presence of the lines in a tubular necessarily obstructs the inside of the tubular and limits its use. Also, deeper wellbores and longer lines increase the complicated process of inserting the lines into the wellbore behind the component and increases the chance the lines will become tangled or otherwise damaged during their insertion, operation or removal. Also, each component requires its own lines creating a tangle of lines in a wellbore utilizing multiple components.

There is a need therefore, for an apparatus and method to supply operating power to a downhole component without the need for separate power lines extending from the surface of the well to the components in the wellbore. There is an additional need for methods and apparatus to control downhole components without the need for separate control lines extending from the components back to the surface of the well. There is a further need for flexible methods and apparatus, which permit downhole components to be operated and controlled at various locations within the wellbore. There is yet a further need for methods and apparatus to provide operation and control of wellbore components without the need for control and power lines running from the surface of the well to the component within the same tubular as the component. There is yet a further need for methods and apparatus including a ready source of power and/or controlling means for a downhole component which is lowered into the well without its own control and power lines. There is a further need for a source of power and control which can be utilized by multiple downhole components or by separate components at different times over the life of the well.

SUMMARY OF THE INVENTION

The present invention provides apparatus and methods for controlling and/or powering downhole components without the need for control and/or power lines extending from the components to the surface of the well and without the need for power or control lines to be inserted into the wellbore along with the components. In one aspect of the invention, a borehole is lined with a casing, the casing having at least one aperture disposed. Adjacent the aperture, on the outer surface of the casing, is a docking station, which is permanently attached to the casing and includes a socket. After the casing is installed in the borehole, a downhole component can be lowered into the wellbore. The downhole component is equipped with a connector extending from an outer surface thereof. The connector assembly is disposable through the aperture in the casing and, the connector assembly can be connected to the socket of docking station. The docking station, depending upon the needs of the operator, is equipped with a source of electrical and/or hydraulic power via control lines that extend from the docking station back to the surface of the well along the outside wall of the casing. In this manner, control and/or power can be provided to downhole components from a docking station without the need of control/power lines being run into the wellbore with the components.

In another embodiment, the aperture in the casing wall includes a window, which is preformed at the surface of the well and has a key-way in the upper portion thereof. The docking station is installed adjacent the key-way. After the casing is installed in the wellbore, another tubular member with an alignment key can be located within the casing and a connector on the other tubular member can be connected to the docking station to provide power/control to the component.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF A PREFERRED EMBODIMENT

Figure 1:
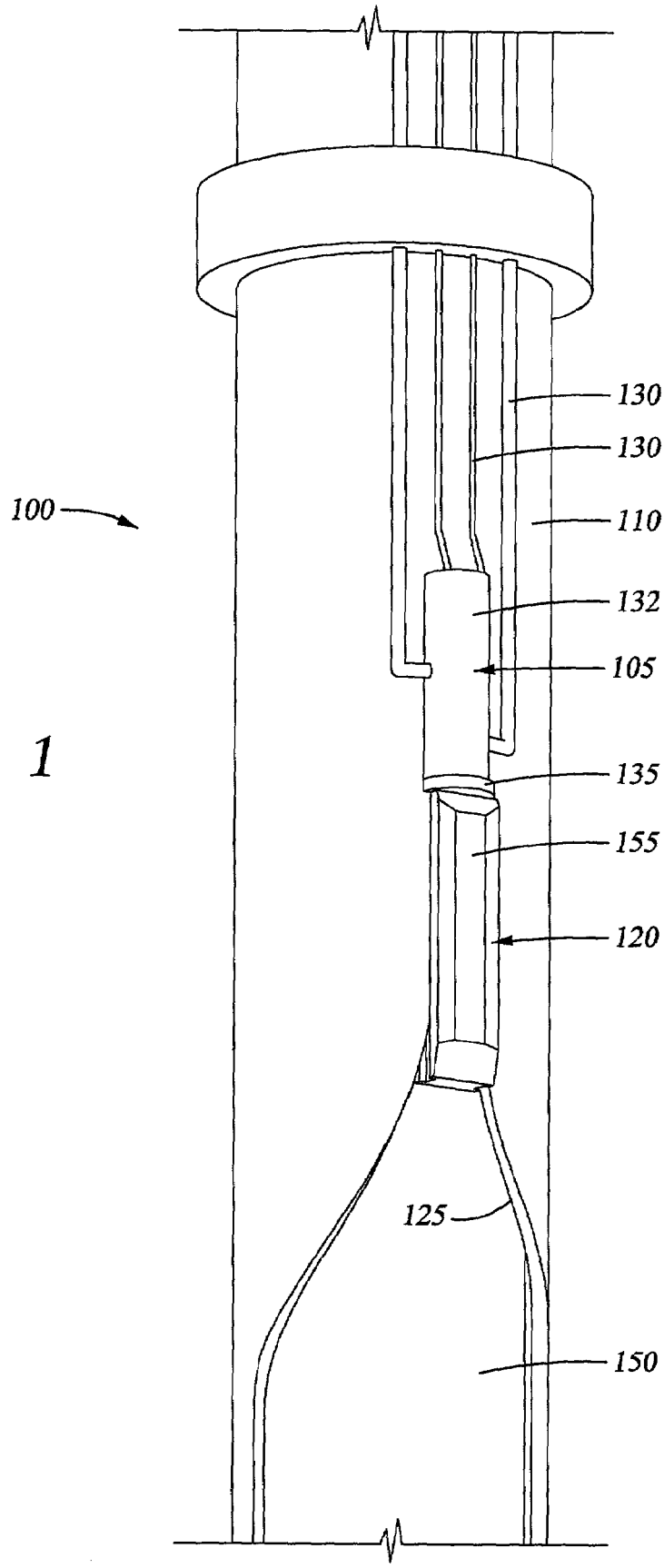
FIG. 1 is a simplified, perspective view of a docking station assembly of the present invention.

FIG. 1 is a simplified, perspective view of a docking station assembly of the present invention. The docking station assembly 100 includes a docking station 105 disposed on the outer surface of a tubular 110 and accessible by a component (not shown) on the inside of the tubular via a connector assembly 120 and an aperture 125 formed in a wall of the tubular 110. The docking station 105 is typically disposed on the outer surface of wellbore casing with control and/or power lines 130 extending back to the surface of the wall. The docking station 105 includes a housing 132 having a socket 135 located therein. The housing 132 is built in a robust manner to protect the docking station from damage during run-in of the casing into the wellbore and subsequent cementing therein.

Adjacent the socket portion of the docking station 105 is aperture 125 formed in the wall of the tubular 110. The aperture is designed to permit access to the socket 135 of the docking station 105 by the connector assembly 120. The aperture 125 is typically formed at the surface of the well but may be an integral part of a window formed in the tubular or casing at the surface of the wellbore or formed in the wellbore to permit the drilling of a lateral wellbore from the central or primary wellbore. Ideally, tubular 110 having the docking station 105 disposed thereupon is run into the wellbore and subsequently cemented therein.

The connector assembly 120 is preferably disposed on the outer surface of a separate tubular or component. In FIG. 1 for example, the connector assembly 120 is disposed on the outer surface of a liner 150 and is visible through aperture 125 formed in the wall of tubular 110. Preferably, the connector assembly 120 is disposed on the outside of a tubular that will be run into a wellbore with some type of component (not shown) requiring power and/or control means to operate within the wellbore. The connector assembly 120 can be disposed directly on the component or more typically, on a tubular which makes up a part of the body of the component or a tubular which is spaced from the component but is part of the same run-in apparatus which transports the component into the wellbore.

In use, the connector assembly 120 travels into the wellbore with the component to which it is connected with electric or hydraulic lines. Upon reaching a predetermined depth, the connector assembly 120 is connected to the docking station 105 by manipulation from the well surface, typically by rotation and axial movement of the tubular 150 bearing the connector assembly 120.

Figure 2:
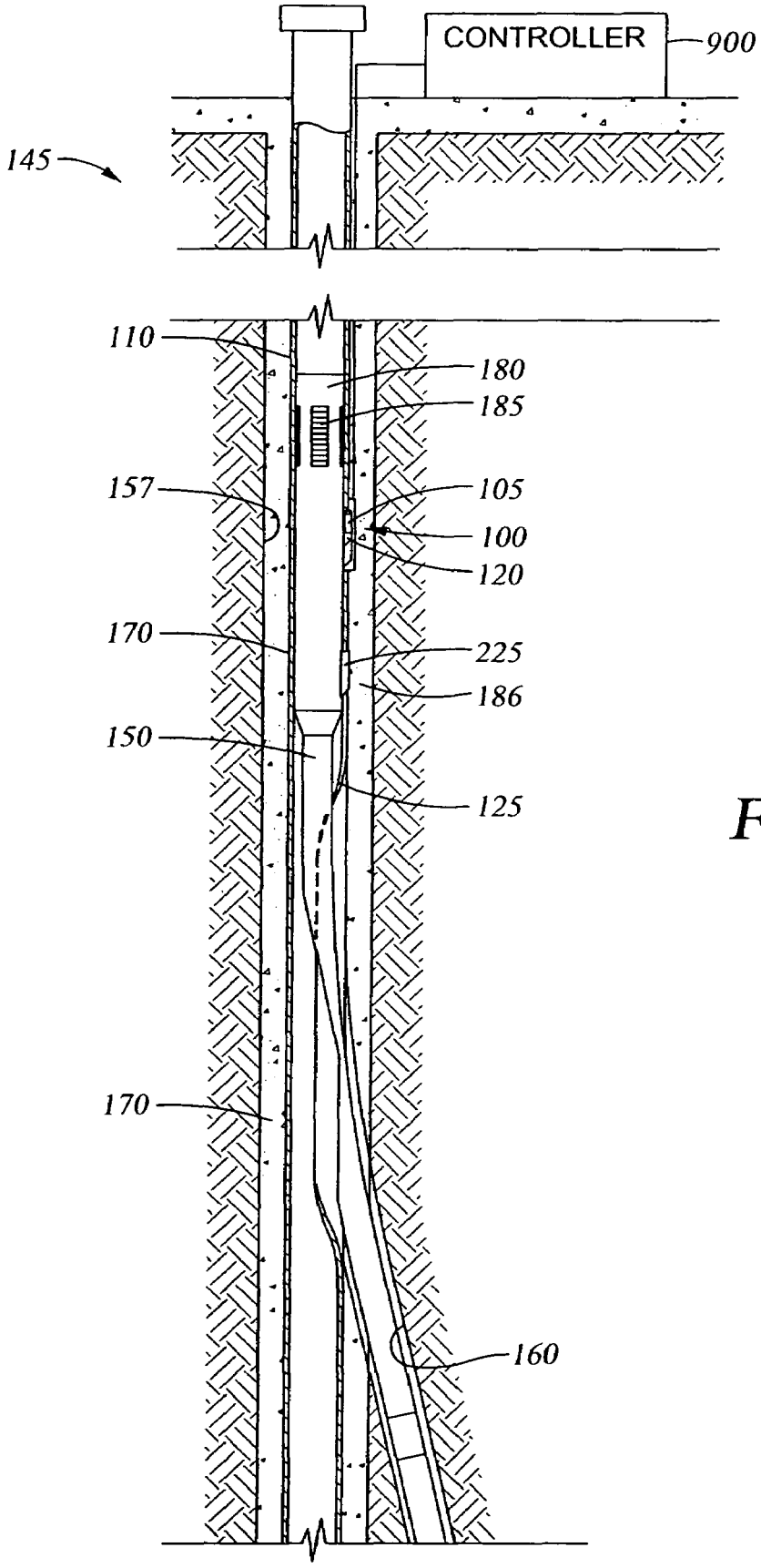
FIG. 2 is a section view of a well having a central wellbore, a lateral wellbore, a key and key-way arrangement and a connector assembly.

FIG. 2 is a section view of a well 145 having a central wellbore 157 and a lateral 160 wellbore. The central wellbore is lined with tubular 110 and an annulus 170 between the casing and the borehole therearound is filed with cement to further isolate the wellbore. A window 125 formed in the tubular 110 consisting of an opening in the casing wall provides access to the lateral wellbore 160. In the embodiment shown, the window 125 is a preformed window meaning that the casing is run into the well with the window already formed therein. In the central wellbore 157 is a liner hanger 180 with a slip assembly 185 on the outer surface to grasp the inside of the tubular 110. A liner 150 extends below the liner hanger and extends through the window 125 of the casing and into the lateral wellbore 160.

Located on the exterior of the liner, proximate the slip assembly 185 is a connector assembly 120 which is connected to a component in the interior of the liner 150 by control/power line(s) 130 (not shown). The connector assembly 120 includes a connector (not shown) that mates with a socket (not shown) in a docking station 105 located on the outside of the casing wall. The docking station 105 is connected with one or more lines 130 (not shown) to a source of power/control at the surface of the well. As will be more fully discussed herein, the docking station 105 is run into the well with the casing and is initially sealed to the exterior of the casing. Thereafter, the connector assembly 120 and the component 200 travel down with the liner as the liner is run into the wellbore. As the connector is aligned with the docking station, the connector accesses and mates with the socket formed on the docking station. At the surface of the well is a controller 900 which provides information to the docking station via the control/power lines running between the controller and the docking station. Lines 130, as described are used to control and/or to power components in the wellbore. The lines 130 extend from the surface of the well to a docking station 105 and are inserted when the casing or docking stations are run into the well. Like the docking station, the control/power lines may be protected from physical or chemical abuse by coverings or protective coatings. In some instances, the lines 130 may utilize pressurized fluid, especially when used to control hydraulic components. In other instances, the lines may include electrical conductors to provide power to components or electrical control devices. In other instances, fiber optic cable, because it is resistant to radio frequencies can be utilized to carry control or power or both.

Visible in FIG. 2 at a lower end of the liner hanger 180 is a key and keyway arrangement 186 consisting of an outwardly extending key 225 on the exterior of the liner hanger and a slot-shaped key-way (not shown) vertically arranged in the casing wall at an upper end of the window 125. The purpose of the key-way is to receive the key thereby locating the liner within the casing both axially and rotationally. As will be discussed herein, the key and key-way are used to ensure that the connector assembly 120 is properly oriented with respect to the docking station 105. The key-way is a relatively narrow, vertically formed aperture located at the upper end of the preformed window 125 in the casing. The relative width of the key-way and its relationship to the window 125 is visible in FIGS. 7–9. At a lower end of the key-way 200, the casing wall widens into the window 125 that will accommodate the liner 150 as it passes through the tubular 110 (FIG. 3).

Figure 3:
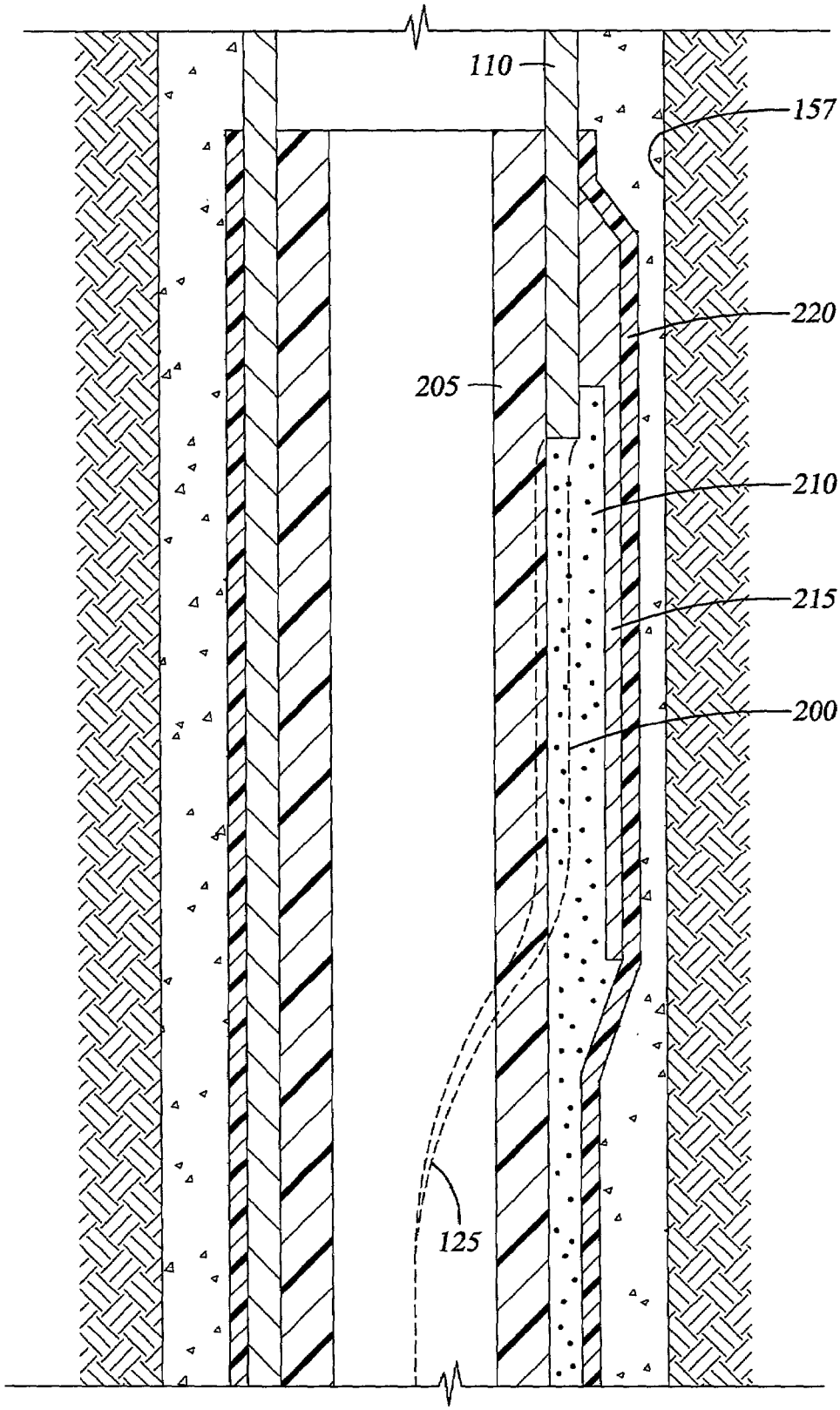
FIG. 3 is an enlarged section view of casing in the area of the key-way as it appears after the casing is run into the wellbore and cemented therein.

FIG. 3 is an enlarged section view of the tubular 110 in the area of the key-way 200 as it appears after the casing is run into the wellbore 157 and cemented therein but before a liner is run into the wellbore with a key to fit within the key way. The key-way 200 is designed to tolerate the harsh conditions present at the exterior of the casing during run-in into the wellbore and also during the circulation of fluids, like cement around the exterior of the tubular 110. To provide the needed protection in the area of the key-way 200, that portion of the casing where the key-way is located is isolated. The isolating elements include an inner pipe 205 formed of some drillable material, like plastic. The pipe 205 provides a temporary inner wall of an isolated space 210 formed between the outer wall of the pipe and a metal shield 215 disposed outward of the pipe. The isolated space 210 is filled with grease, gel or some other material effective in filling the area and keeping other fluids, like cement and wellbore fluids from entering. Disposed around the outside of the casing is a metal shroud 220 to hold the assembly together and provide additional protection against abuse.

After the casing is run into the wellbore and cemented therein, the preformed window 125 in the casing is drilled by a mill or drill that passes through the window to form a lateral wellbore. Parts of the isolating elements protecting the key way are destroyed during this milling/drilling, leaving the key way 200 exposed for receipt of a key on liner that is subsequently run into the well.

Figure 4:
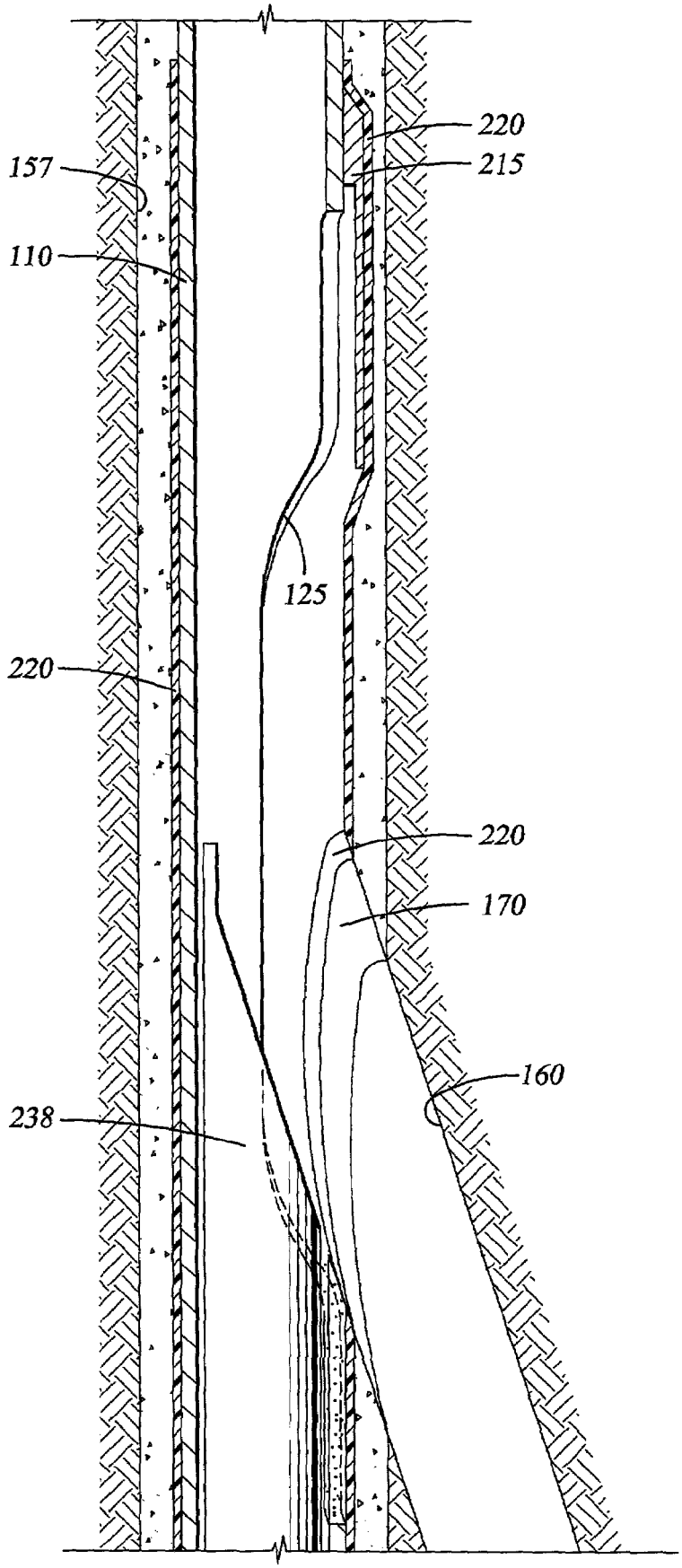
FIG. 4 is a section view of the wellbore after a lateral wellbore has been formed.

FIG. 4 is a section view of the wellbore 157 after the lateral wellbore 160 has been formed by drilling though the window 125 formed in the tubular 110. As illustrated, a drill or milling apparatus has passed through the window and destroyed the isolation elements surrounding the area of the docking station. To facilitate the formation of the lateral wellbore, a whipstock 238 is run into the well and anchored therein. Thereafter, the drill or mill is urged down a concave face of the whipstock and though the window. As the drill/mill passes through the window, it forms an opening in the annular area 170 filled with cement, the shroud 220 and any gel or grease remaining in the isolated area 210. After formation of the lateral wellbore 160 is complete, the whipstock may be removed from the wellbore 157.

Figure 5:
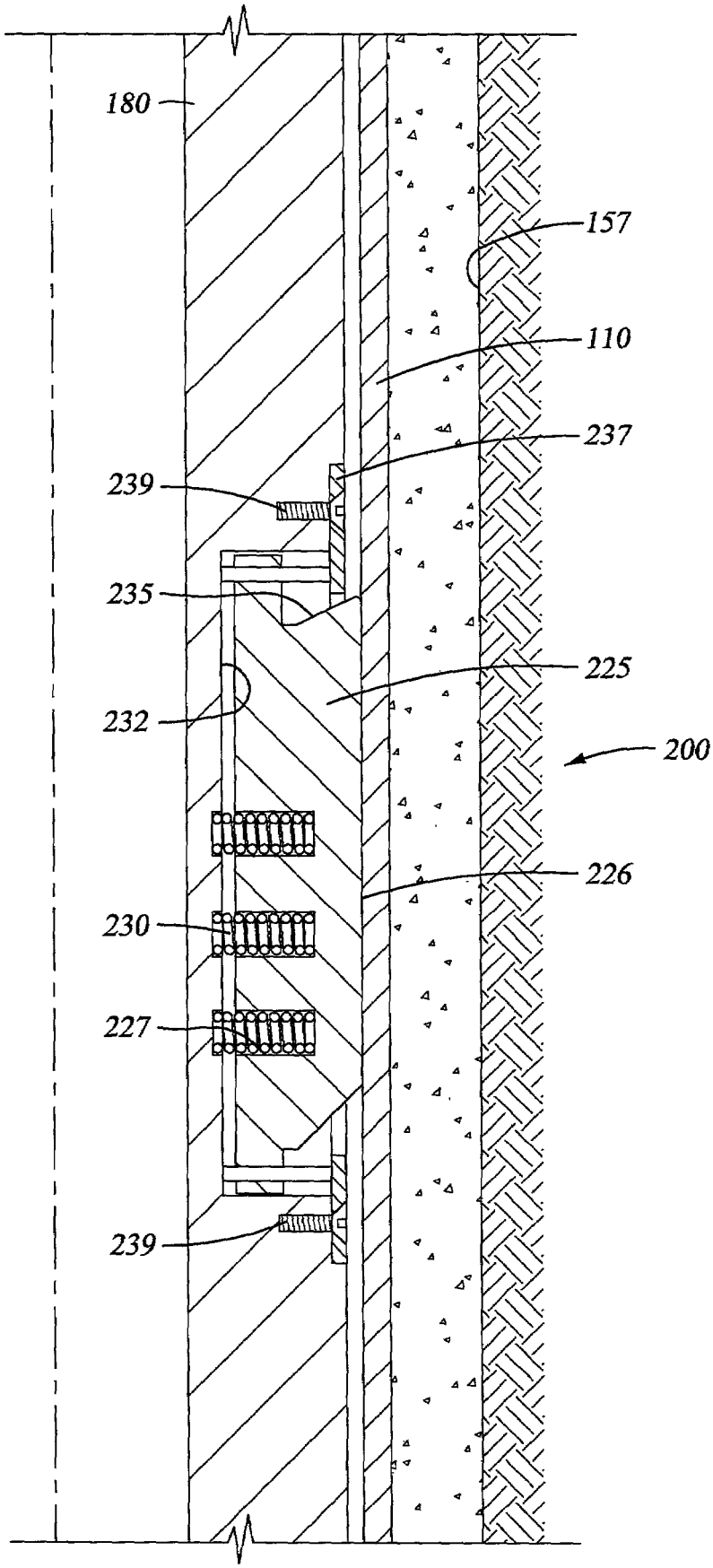
FIG. 5 is a section view of a liner hanger in the run in position and illustrating a spring-loaded key.
Figure 6:
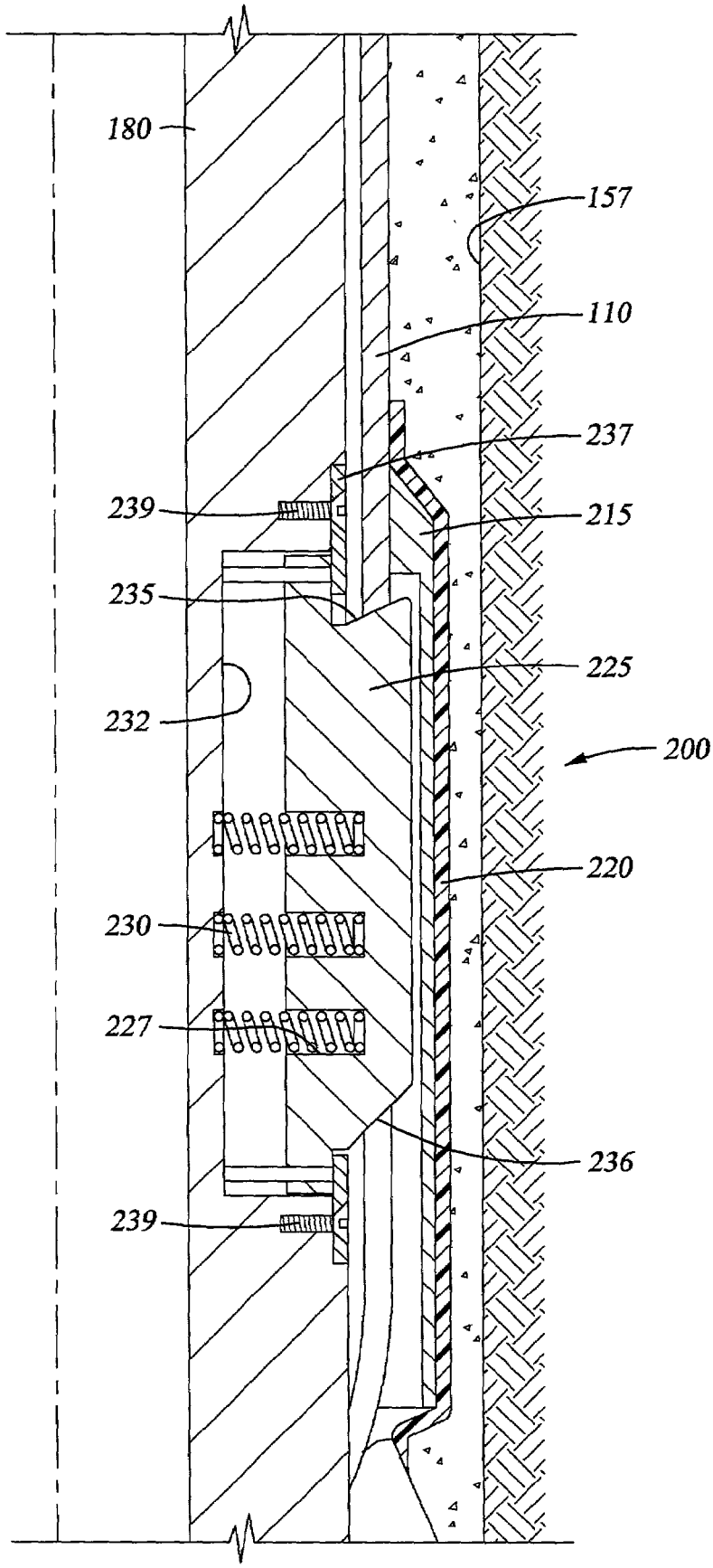
FIG. 6 is a section view showing that area of the casing that includes the key-way formed at an upper end of a window.

FIG. 5 is a section view of the liner hanger 180 in the run in position illustrating a key 225 that travels along the exterior of the liner hanger 180 as the liner moves down the wellbore inside of the tubular 110. In the embodiment of FIG. 5, the key 225 is spring loaded and is biased against the casing wall until it intersects the casing window 125. The key assembly includes the key 225 having a substantially flat outer surface 226 and an inner surface with three bores 227 formed therein to receive three springs 230. The key is housed in a recessed area 232 of the liner wall and the recessed area has mounting surfaces for the three springs 230. An upper edge of the key has an under cut surface 235 to facilitate the landing and retention of the key in the key-way (FIG. 6). A mounting plate 237 surrounds the key assembly and holds it together with fasteners 238.

FIG. 6 is a section view showing that area of the tubular 110 that includes the key-way 200 formed at an upper end of window 125 (not shown). In FIG. 6, the inner pipe 205 and a lower portion of the shroud 220 making up the isolation elements of the key way have been removed by drilling, leaving only the shield 215 portion completely intact. Specifically, the inner pipe 205 and shroud 220 are destroyed as a mill/drill is used to open the preformed window 125 in the casing and form the lateral wellbore 160 therefrom. In FIG. 6, the liner hanger 180 has been run into the wellbore to the location of the key-way 200 and the biased key has extended outwards and has been positioned in the key-way 200. The under cut 235 of the key 225 is in contact with a lower edge of the casing and a lower sloped portion of the key 225 with a notched formation, is in contact with the mounting plate 237.

Figure 7:
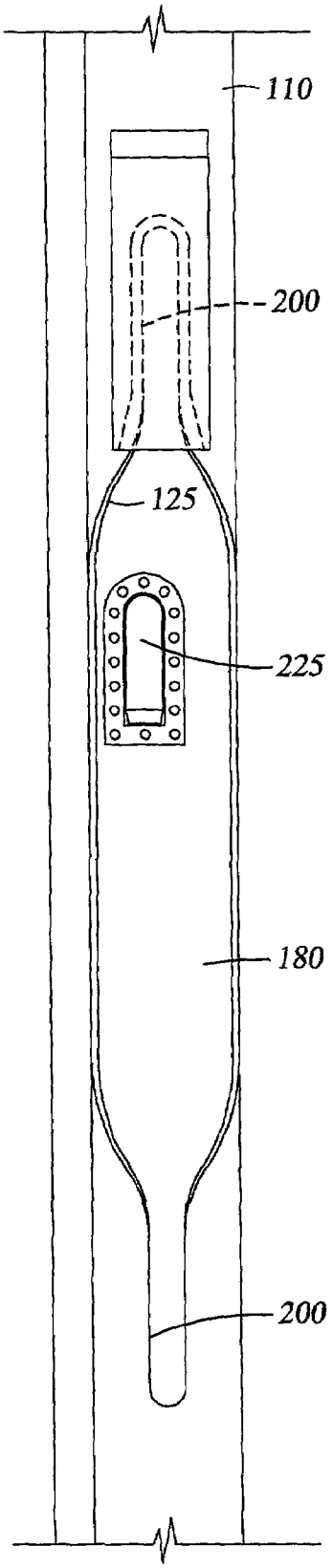
FIGS. 7 through 9 illustrate the locating procedure whereby the liner hanger is located relative to a key-way formed adjacent a window in wellbore casing.
Figure 8:
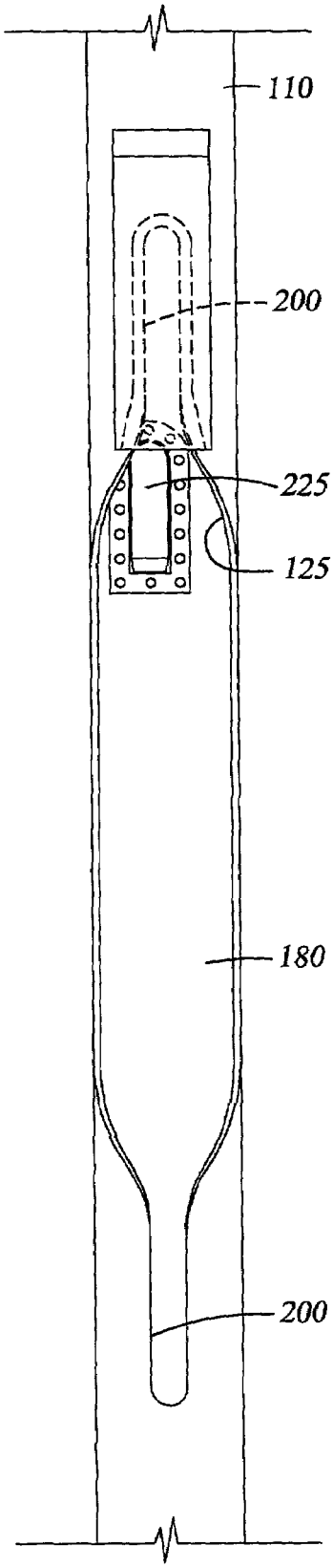
Figure 9:
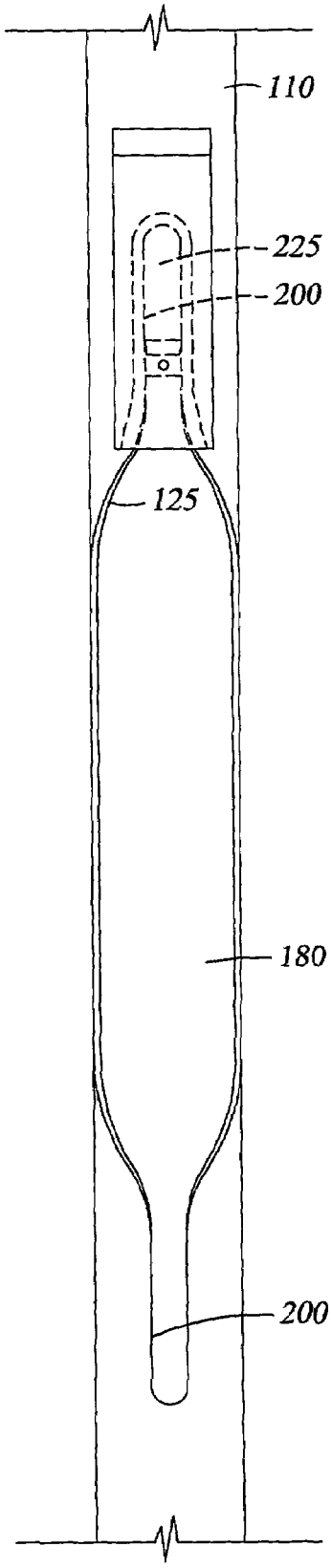

FIGS. 7–9 illustrate the locating procedure whereby the liner hanger 180 with its key 225 is located within the key-way 200 of the tubular 110. In FIG. 7, the liner hanger 180 bearing the key 225 has been run into the wellbore to a depth wherein the key has intersected the window 125 through which the lateral wellbore will be formed. As it intersects the window, the spring loaded key 225 extends from the liner 150 and can be used to align the liner using the walls of the window 125 and the key-way 200 there-above. In FIG. 8, the liner 150 and the key 225 have been raised vertically within the tubular 110 and the extended key 225 has aligned the liner hanger rotationally as the key is urged towards the key-way 200. In FIG. 9, the liner hanger 180 is shown in that axial and rotational position wherein the key is properly located at the top of the key-way 200. FIG. 9 corresponds to FIG. 6. In FIGS. 7–9 a key-way 200 is provided at the upper and lower end of the window. In an alternative method, the key could be located in the lower key-way.

Figure 10:
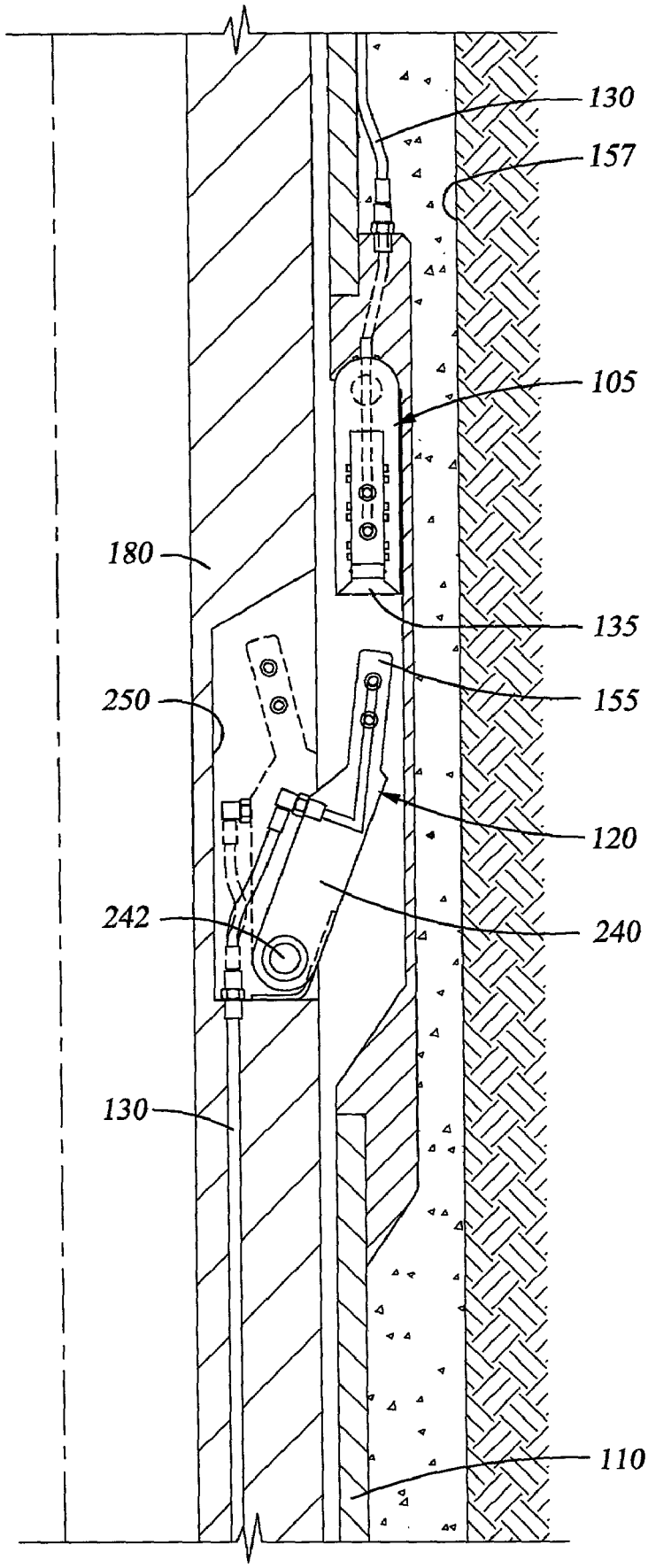
FIG. 10 is a section view showing a connector assembly carried on a liner for connection to a socket of a docking station.

FIG. 10 is a section view showing the connector assembly 120 that is carried on the liner hanger 180 and travels down the wellbore 157 to be connected to the socket 135 of the docking station 105. As illustrated in FIG. 2, the connector assembly is typically located in the liner hanger 180 at a point below the key 225. The connector assembly includes an arm 240 that pivots outwards at a first end 242 and is biased in an outward direction towards the wall of the casing. At an opposite end, the arm includes a connector 155 that is constructed and arranged to be housed in the socket 135 of the docking station 105.The connector assembly 120 includes a control/power line 130 and the socket 135 is equipped with a control/power source line 130 extending back to the surface of the well. Shown in dotted lines in FIG. 10 is the position of the arm 240 in the run-in position as the arm is held inside a recess 250 in the hanger 180 by the wall of the tubular 110 as with the spring loaded key 225 of FIG. 5. In solid lines, the connector 155 is shown in a portion after it intersects the housing of the docking station 105. As shown by the solid lines, the arm 240 has moved to a position wherein the connector 155 extends outwards and is rotationally aligned with the socket 135.

Figure 11:
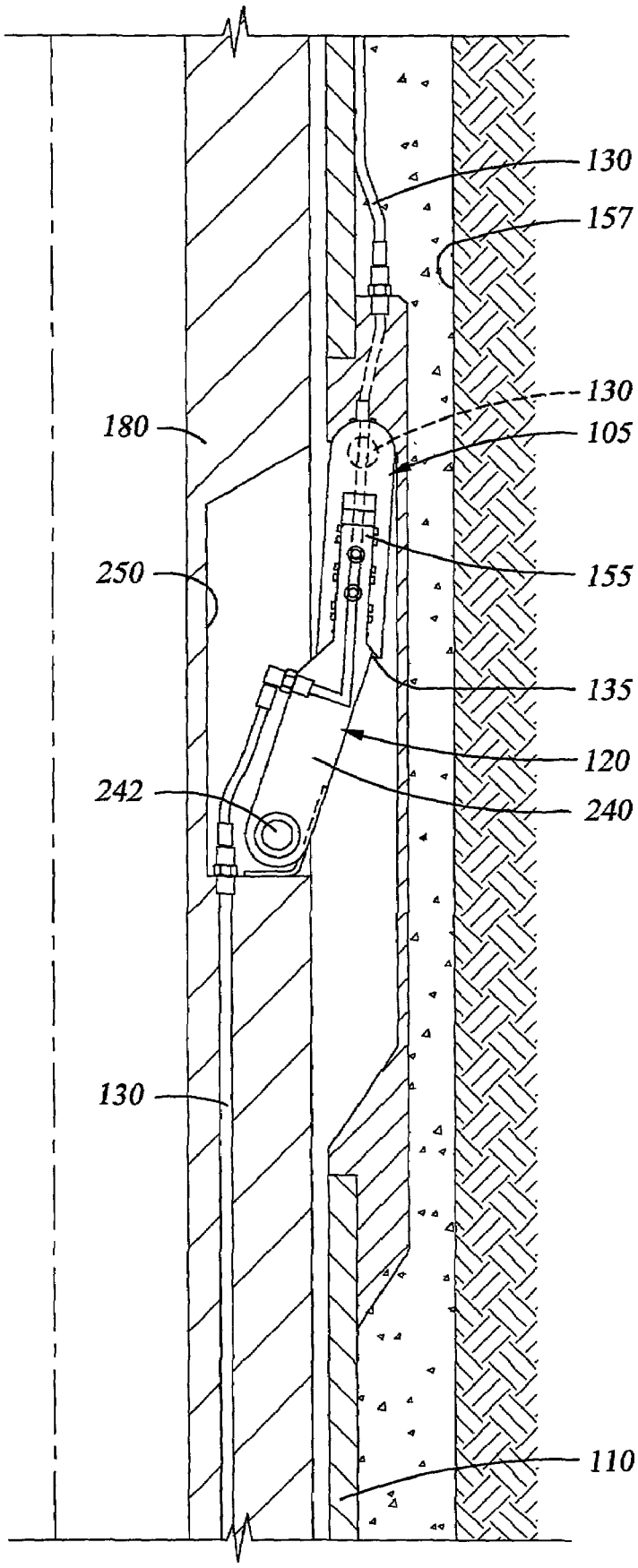
FIG. 11 is a section view of a wellbore showing the connector of the connector assembly housed within a socket of the docking station.

The connector 155 aligns with the socket 135 due to the movement of the key 225 within the key way (FIGS. 7–9). Because the distance between the key 225 and the connector 155 is carefully spaced, the location of the connector with respect to the socket 135 can be determined by the location of the key 225 with respect to the key-way 200. FIG. 11 is a section view of the wellbore showing the connector 155 of the connector assembly 120 housed within the socket 135 of the docking station 105. In the embodiment shown the socket includes a pivot at a distal end thereof, the pivot permitting the proximal end of the socket to align itself with the connector 155. As illustrated, upward movement of the liner hanger 180 within the tubular 110 has brought the connector 155 into the socket 135 and the control/power lines 130 from the connector are connected to the control/power lines 130 extending back to the surface of the well and to the controller (not shown). The position of the connector with respect to the socket in FIG. 11 corresponds to the positioning of the key 225 with respect to the key way 200 in FIG. 6.

Figure 12:
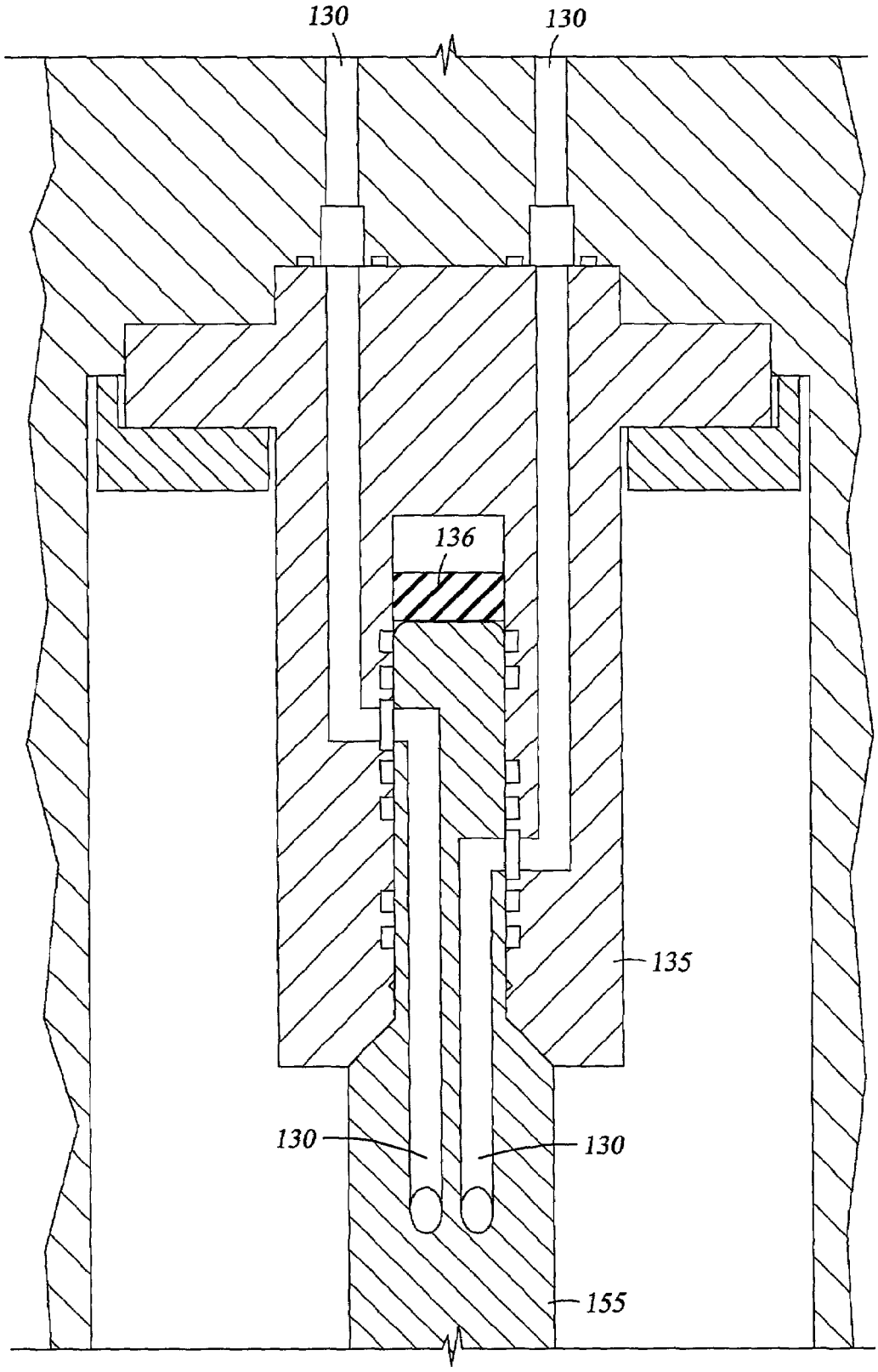
FIG. 12 is a section view of the connector housed in a socket of the docking station.

FIG. 12 is a section view of the connector 155 housed in the socket 135 of the docking station. The Figure illustrates a path of the control/power lines 130 from the connector 155 through the connector/socket connection and on towards the surface of the well and the controller (not shown). In the embodiment illustrated, there are two lines 130 extending through the connector assembly 120. One line could be a power line carrying an electrical current a first downhole component and a second line could carry fluid power to operate the same or another component in the wellbore. The control/power lines exit each side of the connector at a fitting that aligns with a similar fitting in the interior of the socket 135. A plunger 136 is located in the bore of the socket 135 to prevent the migration of fluid into the socket and to seal the connection between the connector 155 and the socket 135. The plunger is initially positioned at an opening of the socket and is urged into the socket by the connector 155. In this manner, debris and fluid is prevented from entering the socket until the connector is inserted.

Figure 13:
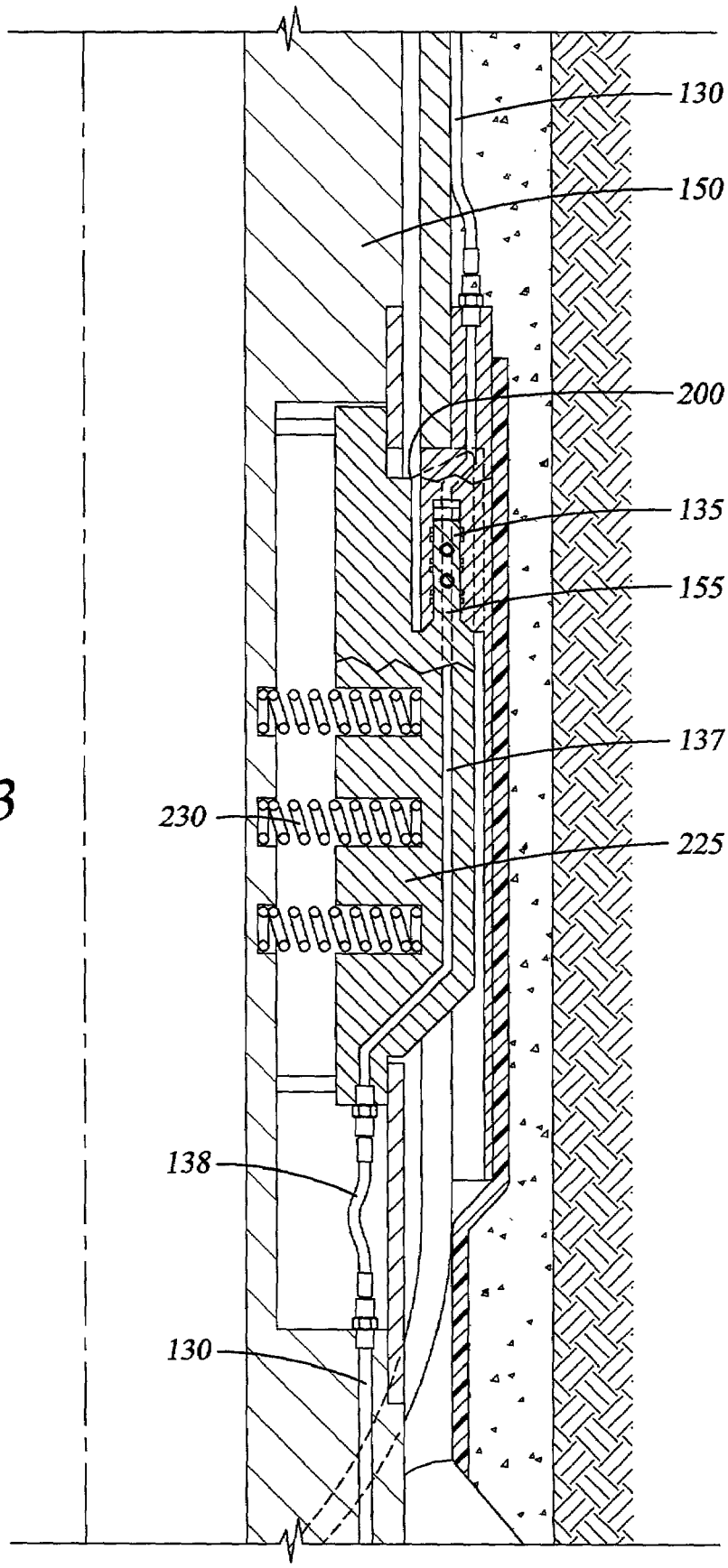
FIG. 13 shows a key and connector both, located together on a liner hanger.

FIG. 13 is an illustrative embodiment of the invention wherein the key 225 and connector 155 are both located together on the liner 150. As shown in the figure, the key is spring loaded with a spring members 230 biasing the key in a radially outward direction. Integrally formed in the key is a control/power path 137 extending from the bottom to the top of the key. At a lower end, the path is connected to a flexible line 138 having enough slack to permit the key to extend outwards as the key locates itself in a key-way of a casing window. At an upper end of the path 137 is a connector 155 for connection to a socket 135 formed at an upper end of a key-way 200. The assembly is constructed and arranged whereby the connector 155 is located in the socket 135 as the key 225 is located in the keyway 200.

Figure 14:
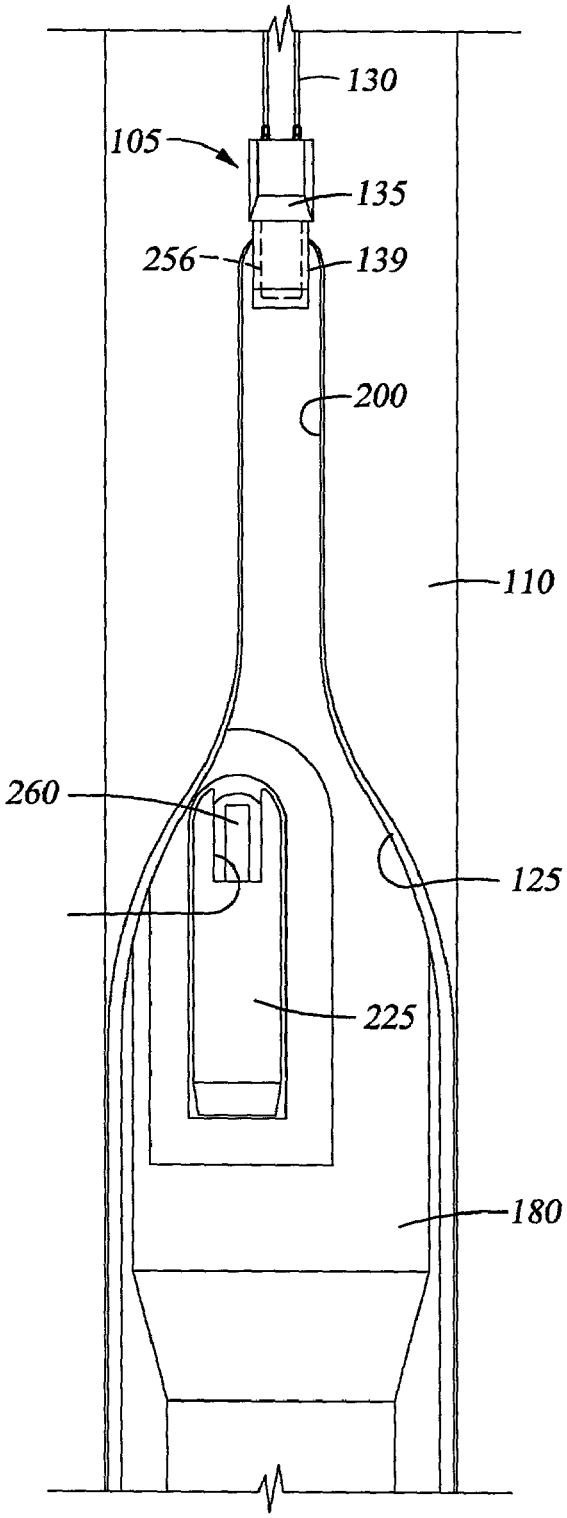
FIGS. 14 and 15 illustrate another embodiment of the invention and a relative position of a key and key-way as a liner hanger is located in a key-way.
Figure 15:
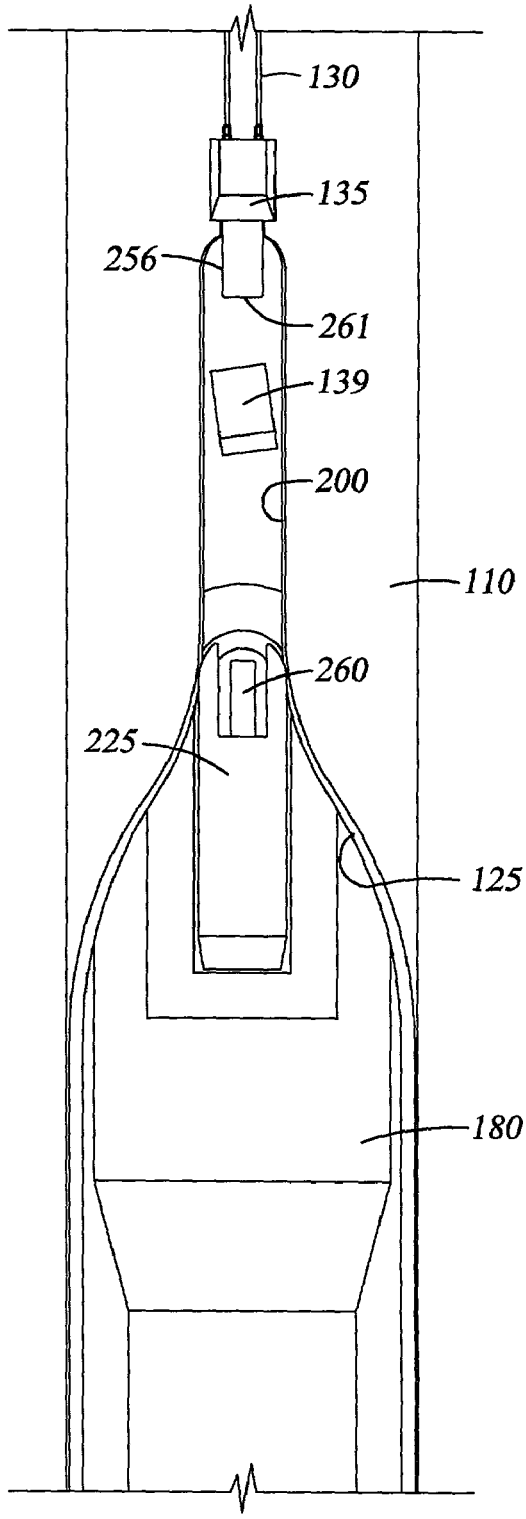

FIGS. 14 and 15 illustrate another embodiment of the invention and the relative position of the key and key-way as the liner hanger 180 is located in the window 125 of the tubular 110. In FIG. 14, the key 225 includes a female socket portion 255 having an outwardly extending prong 260 located in the center thereof and the docking station 105 includes an outwardly extending male portion 256 having a socket 261 (FIG. 15) in a distal end thereof. The male portion and socket 261 of the docking station 105 is temporarily protected from debris and wellbore fluid during run-in and cementing by a cap 139 which covers an opening at a distal end of the male portion 256. In FIG. 14, a spring loaded key 225 on the liner 150 has been located in the window 125, permitting the biased key to extend past the edge of the window. In FIG. 14, as the key 225 is aligned with the key-way 200, the cap 139 is disposed over the end of the male portion. In FIG. 15, as the key 225 with its female socket portion 255 approaches the male portion 256, the cap 139 is "blown off" of the male portion, typically through the use of fluid or air pressure controlled from the surface of the well.

Figure 16:
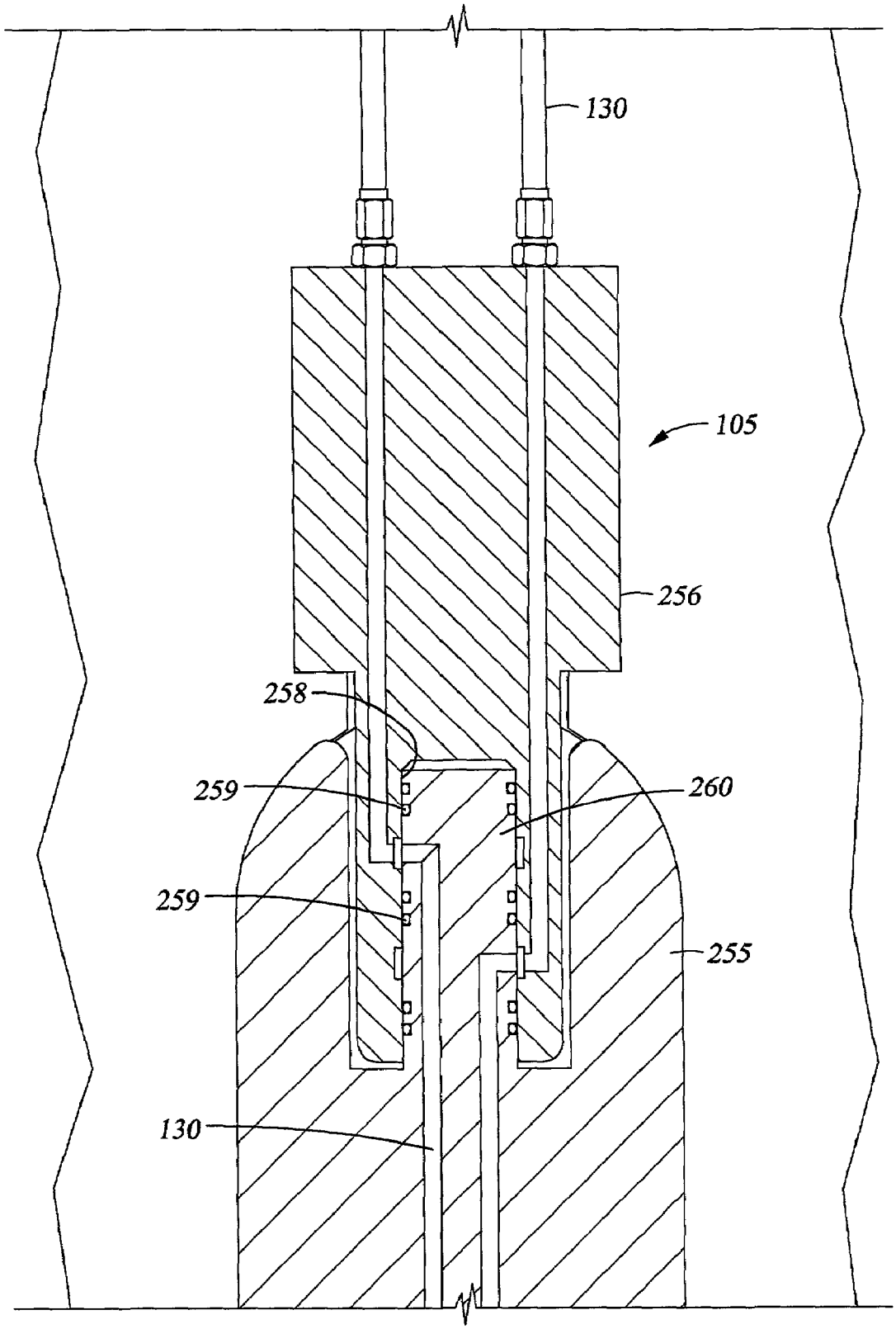
FIG. 16 illustrates the embodiment of FIGS. 13 through 15 and shows an outwardly extending male portion of a key mated to a female socket portion of a docking station.

FIG. 16 illustrates the embodiment of FIGS. 13–15 with the outwardly extending male portion 256 of the key 225 mated to the female socket portion 255 of the docking station 105. Two power/control lines 130 extend through the key 225 to the connector male portion 256. The lines 130 typically extend from the key 225 to a component or components located somewhere along the liner (not shown) and run into the wellbore with the liner 150 and liner hanger 180. Two apertures 257 formed in the outer surface of the prong 260 mate with apertures 258 located in the interior of the socket 261 and seals 259 located therebetween permit fluid communication between the male 257 and female 255 portions. With the connection completed, the component(s) of the liner are connected to a control/power source at the surface of the well via lines 130 that extend from the docking station 105 to the surface of the well along the outside of the tubular 110.

Figure 17:
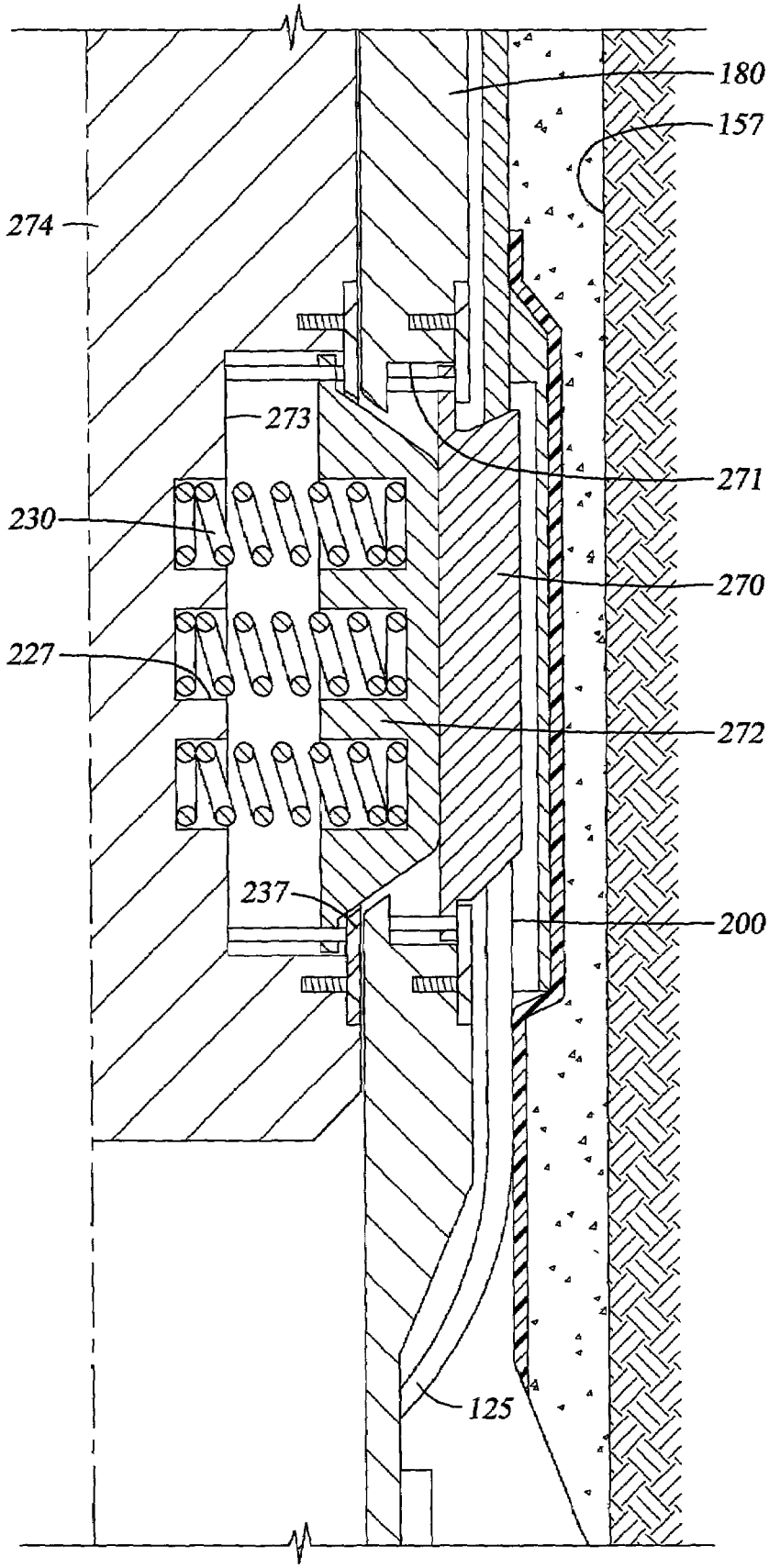
FIG. 17 is a section view of a wellbore illustrating an alternative embodiment of a key arrangement.

FIG. 17 is a section view of a wellbore 157 illustrating an alternative embodiment of a key arrangement used to located the liner hanger 180 with respect to a key way 200 in a casing window 125. In this embodiment, there is a non-biased 270 located in an aperture 271 formed in a wall of the liner hanger 180. The key is mounted in a manner permitting radial outward movement of the key with respect to the liner hanger wall. The outward movement of the key is limited by a mounting plate 237 attached to the liner hanger wall with fasteners. Additionally, a biased intermediate key 272 is disposed in a recessed area of a wall of a run in tool 274. The intermediate key 272 is biased outwards with three springs, each located in a bore 227 formed in the recessed area. The intermediate key 272 is limited in its outward movement by a mounting plate 237 attached to the wall of the run-in tool 274 with fasteners. As the run-in tool and liner hanger 180 reach the area of the window and/or the keyway 200 in the tubular 110, the key 270 is moved radially outwardly and intersects the keyway 200. The embodiment of FIG. 17 saves space in the wall of the liner hanger 180 as the biasing mechanism for the key is provided on a separate and removable run-in tool.

In the embodiments illustrated herein, the key of the liner hanger and the key-way of the casing are used to place the liner in a predetermined location with respect to the casing. Thereafter the liner is typically fixed in the wellbore by actuating the liner hanger. Because rotation of the liner is undesirable after it has been located and a connection has been made using the connector and socket of the docking station, some hanging means is necessary that does not rely upon rotational or axial movement of the tubular being hung. For example, in one embodiment, slip members of the liner are actuated by a combination of mechanical and hydraulic means whereby rotation is unnecessary. Thus non-rotating hangers are well known to those skilled in the art.

After connection between the connector 155 and the socket 140 of the docking station, any component attached to the docking station connector assembly either electrically or through control lines can be operated from the surface of the well as the power and control lines extend from the docking station to the surface of the well. In this manner, downhole components can be run into the well with only a connector operated without separate control or power lines extending back to surface in the wellbore. All power and control lines are disposed on the outer surface of the casing where they are less likely to create a nuisance.

The following are various examples of methods and apparatus of the present invention and their use. The examples are not exhaustive. Because of similarities, certain steps or details described with respect to some examples are equally attributable to other examples and embodiments. The examples are illustrated by schematic Figures. While various components of the invention are not shown in detail in all examples, it will be understood that the examples make use of those embodiments of the invention disclosed in detail in the preceding description and Figures. While the examples illustrate the use of the docking station between the surface of a well and a wellbore component, the docking station and the connectors disclosed herein are useful in providing a direct line of communication between two points in a wellbore and the invention is not limited to use between the surface of the well and a particular component. For example, the docking station could be used to transmit data towards the surface of the well where it could be retrieved by some other wellbore device and transmitted to the surface at some later time by some of the means.

Figure 18:
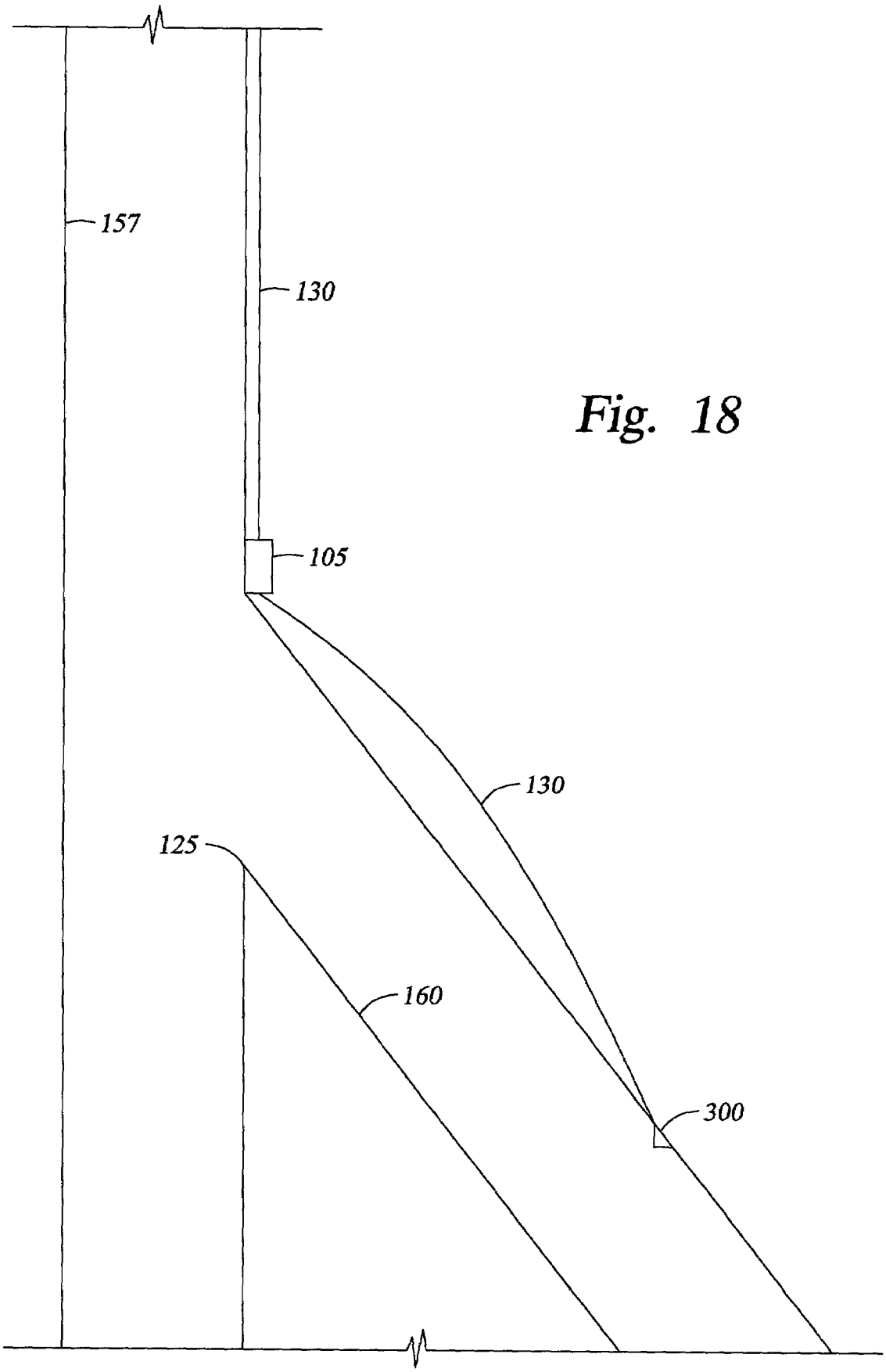
FIG. 18 is a section view of a central wellbore, a lateral wellbore extending therefrom and showing a docking station in use with a chemical injection port.

The docking station of the present invention can also be used in conjunction with the injection of chemicals or other fluids into a wellbore or into formation surrounding a wellbore. FIG. 18 is a section view of a central wellbore 157 with a lateral wellbore 160 extending therefrom. A docking station 105 is disposed on the outer wall of tubular 110 lining the central wellbore adjacent a casing window 125 from which the lateral wellbore 160 extends. Power/control line 130 extends from the docking station 105 to the surface of the well (not shown) along the exterior of the tubular 110. At some location along the lateral wellbore, a chemical injection port 300 is located. The chemical injection port can be opened or closed remotely using power or signals provided in a line 130 from the docking station 105. In this manner, chemicals or other fluids can be injected at one or more points along a wellbore or along a liner which is connected to the control lines at a key-way adjacent the docking station. For example, the fluid can be injected using high pressure pumping from the surface or alternatively, lines 130 can be used to power and control a downhole pumping device. In either case, the components can be controlled from the docking station. The advantages of using the invention in this aspect include the elimination of dedicated lines from the surface of the well for the purpose of injecting fluids in the wellbore. Additionally, chemicals can be injected at multiple points along a liner, or multiple liners in a well containing one or more lateral wellbores.

Figure 19:
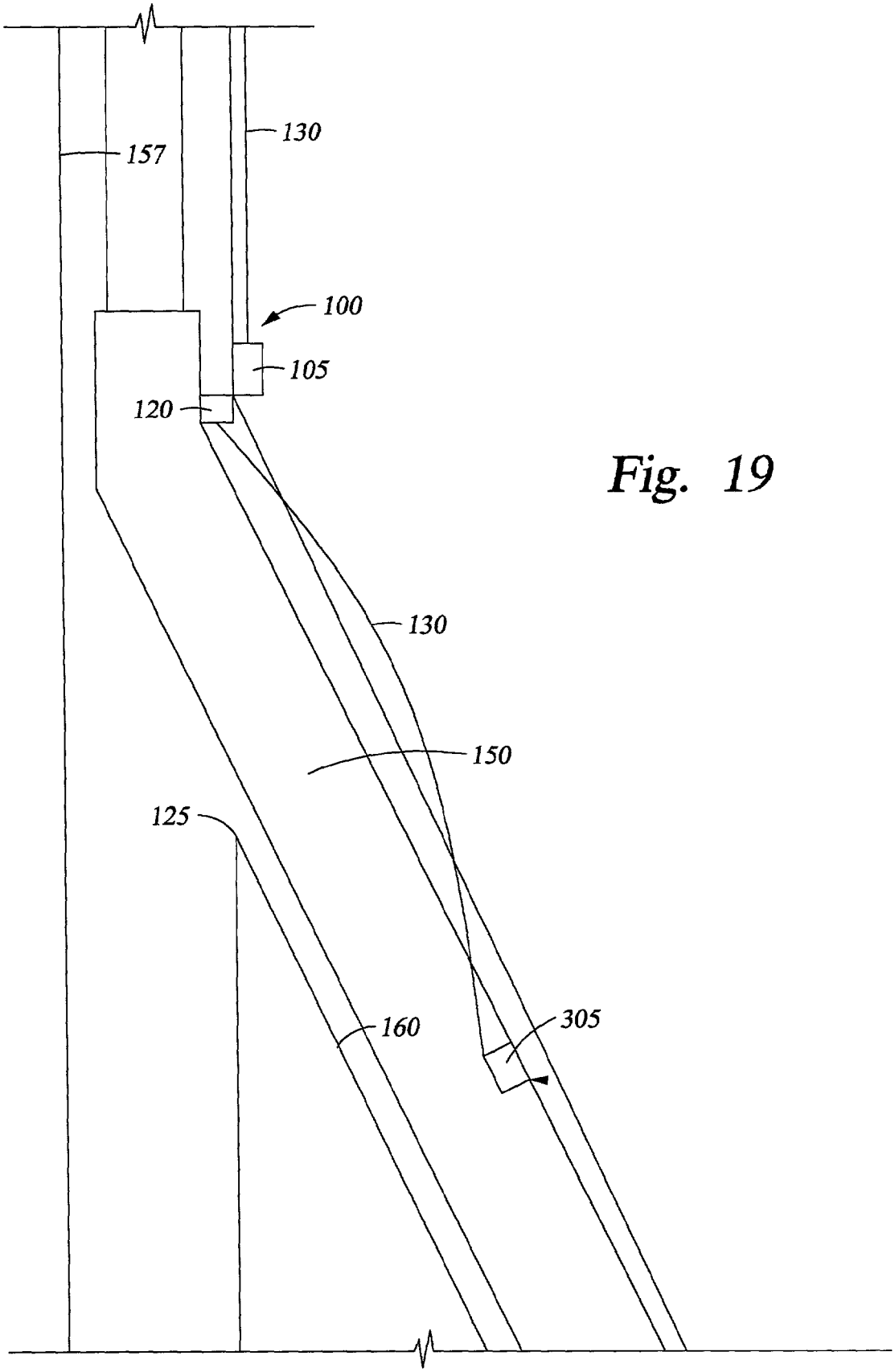
FIG. 19 is a cross section of a central and lateral wellbore including a docking station, a connector assembly, and a control device.

FIG. 19 is a cross-section of a central 157 and lateral 160 wellbore, a docking assembly 100 including a docking station 105 and a connector assembly 120 and a control device 305. A premilled window 125 is formed in tubular 110 of the central wellbore and a string of liner 150 extends from the window 125 and into the lateral wellbore 160. Located in an interior of the liner 150 is control device 305 which is wired with control/power lines 130 to the connector assembly 120. The connector is connected to the docking station 105 in a manner described herein and additional control lines 130 extend from the docking station to the surface of the well (not shown). With the docking station assembly, control/power signals from the surface of the well are sent via control lines 130 to the docking station 105 which is in communication with the control device 305 via control lines 130 extending between the connector and the control device 305.

The apparatus illustrated in FIG. 19 is used in the following manner. A lateral wellbore 160 is formed by drilling though a window 125 in the tubular 110 of a central wellbore 157. Thereafter, the lateral wellbore may be lined with liner 150 or may remain unlined. In either case, a string of tubulars containing the control device 305 can be inserted into the lateral wellbore. Using the docking station assembly described herein, the control device 305 can be electrically and/or hydraulically tied back to the surface of the well. After the assembly is installed, control signals from the surface are sent via the control lines to the docking station 105, which transmits the signals to the control device 305 via other control lines. In addition to the example shown in FIG. 19, the docking station can be utilized to act as a multiplexer and can operate multiple devices (valve, sensors, sliding sleeve, etc.) at one time based upon signals transmitted from a single or multiple control lines from the surface. By using the docking station, multiple control lines for each device need not be run from the surface, thereby reducing the damage to multiple lines and reducing installation costs.

Figure 20:
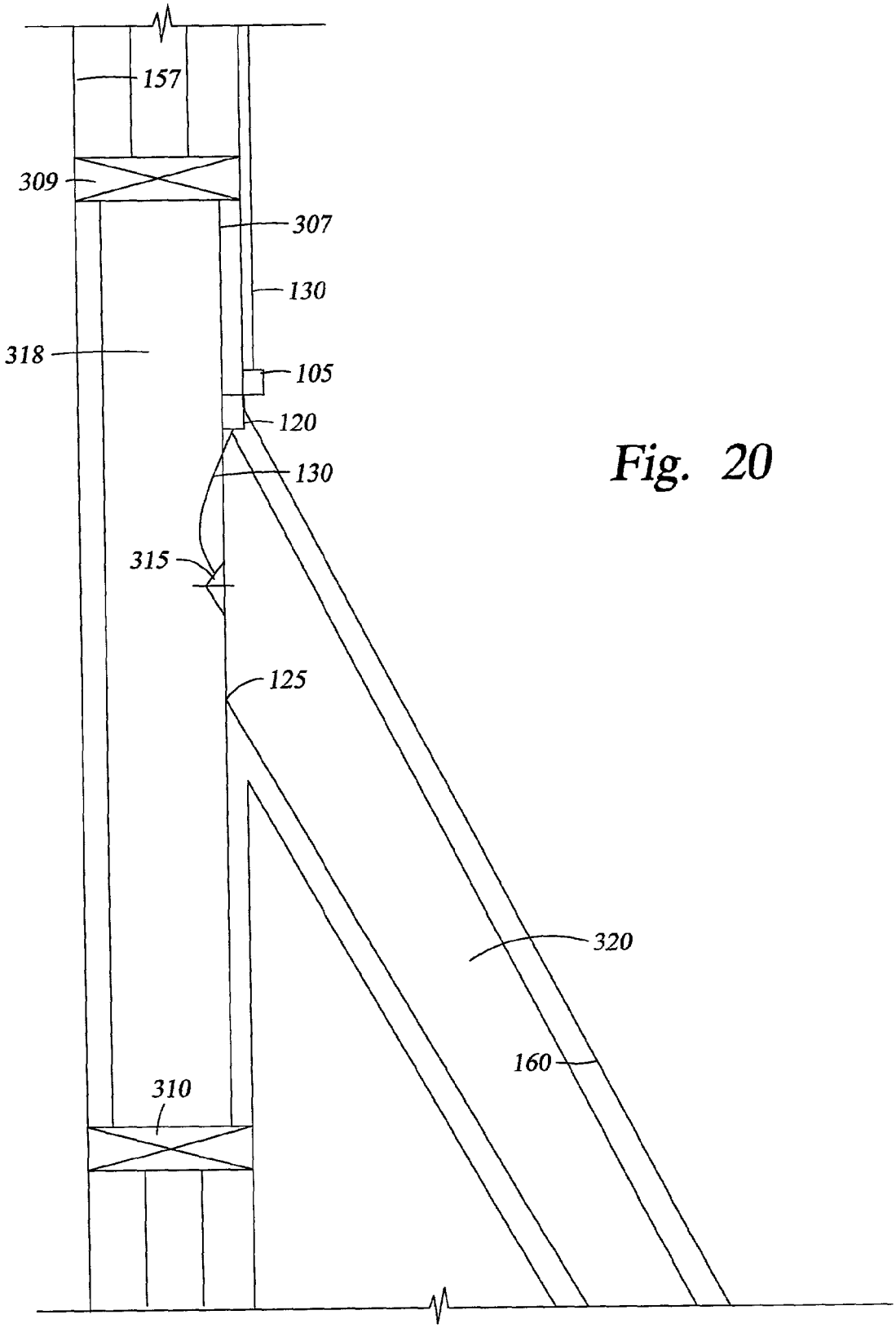
FIG. 20 is a section view of a wellbore including a central wellbore with a lateral wellbore and including a control valve.

FIG. 20 is a section view of a well including a central wellbore 157 with a lateral wellbore 160 extending therefrom. The central wellbore 157 includes tubing 318 therein and the tubing extends below a window 125 in the tubular 110, providing two separate fluid paths between producing areas of the well and the surface of the well. An annular area 307 formed between the tubing 318 and the central wellbore tubular 110 is sealed at an upper and lower end with packers 309, 310. A control valve 315 is disposed across window 125, thereby controlling the amount of production fluid which flows from the lateral wellbore 160 into the central wellbore 157. By utilizing the valve 315 and controlling the fluid produced from the lateral wellbore, the production of the well can be controlled, monitored and adjusted based upon the needs of an operator.

The control valve is connected with control/power line 130 to a connector assembly 120 located on an exterior of a tubular string 320 extending into the lateral wellbore 160. Disposed on the outside of the casing of the central wellbore adjacent the window 125 or a key way formed at an end of the window is a docking station 105 which includes control lines 130 extending to the surface of the well on the outside of the casing. Using apparatus and means described herein, the connector is remotely attachable to the docking station and power/control is provided to the valve 315. Because power is provided from the docking station, there are no control or power lines extending from the connector assembly or the valve back up to the surface of the well in the central wellbore.

In operation, the lateral wellbore 160 is formed either through a preformed window 125 or it is formed using a mill and a diverter like a whipstock. Also formed at the upper edge of the window is a key-way (not shown) adjacent the docking station. Thereafter, a string of tubulars 320 including the connector assembly 120 and the control valve 315 are run into the well to some predetermined location and the assembly is rotated if necessary until the key-way formed on the connector assembly extends through the aperture formed below the docking station and the casing of the central wellbore and connects with the docking station. In this manner, power and control means are supplied to the control valve.

Figure 21:
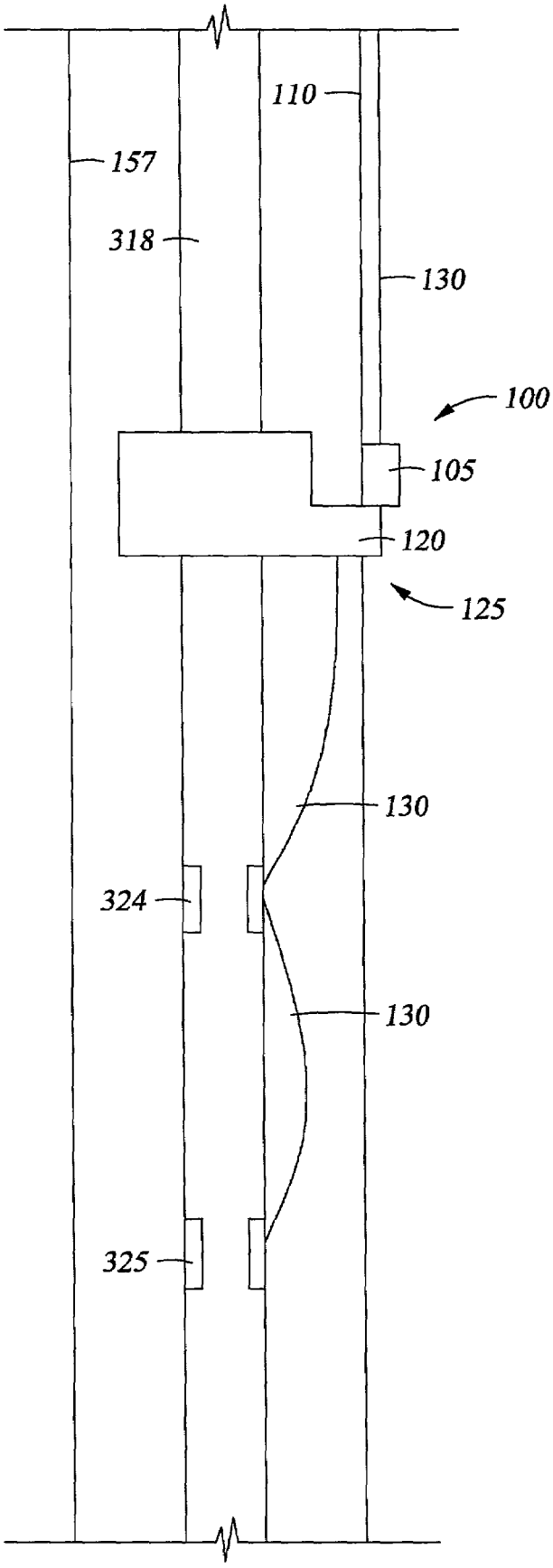
FIG. 21 is a cross section view of a wellbore including a docking station assembly in use with a controllable profile.

FIG. 21 is a cross-section view of a wellbore 157 including the docking station assembly 100 of the present invention in use with a controllable profile. The wellbore 157 includes tubular 110 having a docking station 105 disposed on an outer surface thereof and an aperture 125 formed in the casing wall adjacent the docking station 105. A tubing string 318 having controllable profiles 324, 325 and a connector assembly 120 disposed thereupon is coaxially disposed in the wellbore 157. The connector assembly 120 having a connector 155 (not shown) is coupled to and in communication with the docking station 105 via aperture 125. Control line 130 runs from the surface of the well to the docking station 105. Profiles 324 and 325 are connected to the docking station via control lines 130 and are operated to increase or decrease the effective diameter of the profiles.

In operation, the docking station assembly 100 of the present invention can be used to manipulate the profiles 324, 325 in the tubular string 318 to land drilling, wireline or production tools at predetermined locations in the wellbore. The effective diameter of the profiles can be increased, decreased or changed as required to land the tools. Typically, casing including an aperture and a docking station on a exterior thereof is run into the wellbore and cemented therein. Thereafter, tubular string 318 having a connector assembly 120 and profiles 324, 325 disposed thereupon are run into the well. The connector is connected to the docking station and control/power is established between the surface of the well and the profiles 324, 325. An advantage of using the docking station to expand and retract profiles downhole in the tubing string include being able to use standardize wireline tools for used at multiple locations in the main casing or liner without running new control lines each time.

Figure 22:
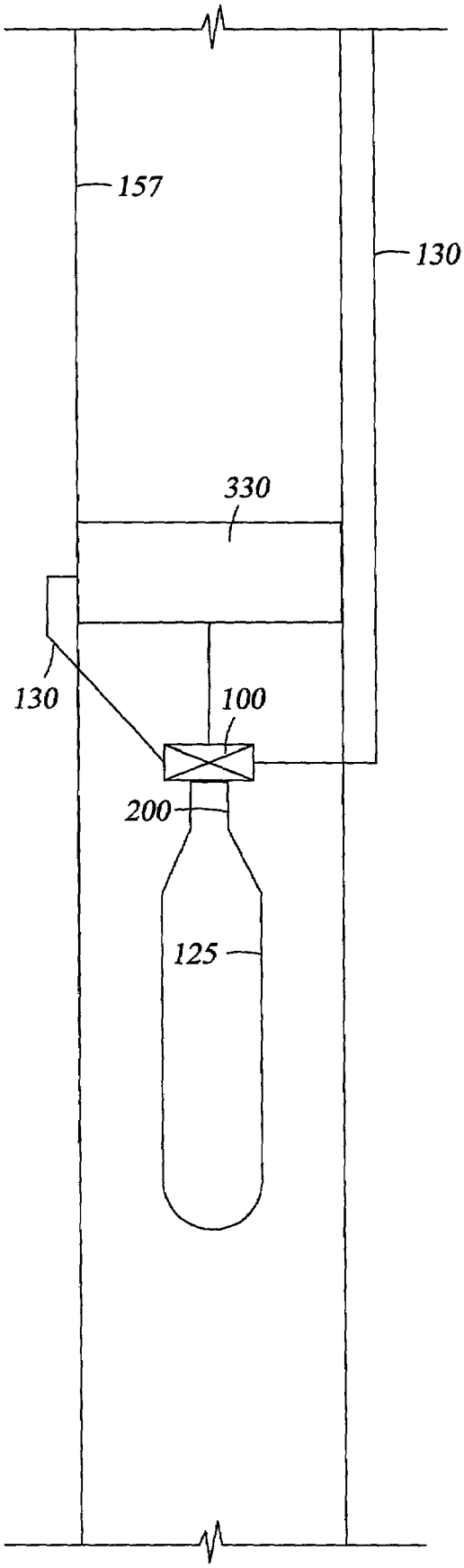
FIG. 22 is a schematic section view of a central wellbore and a wellbore component controlled by a docking station wherein the wellbore component is a deployment valve.

FIG. 22 is a schematic section view of a central wellbore 157 having casing 215 disposed therein. The casing wall includes a window 125 having a keyway 200 formed in the upper portion thereof. The window 125 is an opening formed in the wall of the casing to permit the formation of another wellbore from the central wellbore 157. In the embodiment of FIG. 22, the window 125 is a pre-milled window that is formed at the surface of the well prior to the casing being installed in the borehole. However, the window could be formed in the wellbore through the use of a diverter and a milling tool and the subsequent use of a forming tool to form the key-way 200. Also visible in the figure is a docking station 105 shown schematically and disposed on the outer surface of the casing adjacent the key-way 200. In FIG. 22, the wellbore component powered/controlled by the docking station is a deployment valve 330 disposed on the casing string above the window 125. The deployment valve is connected to the docking station with control/power lines 130 and additional lines 130 extend from the docking station to the surface of the well. The deployment valve is a flapper valve which is located in a casing string and remains open during drilling operations in an under-balanced condition. For example, when drilling with injected gas, the weight of the drilling fluid is less than the formation pressure of the well.

Utilizing the docking station of the present invention, control lines 130 to open and close the deployment valve extend directly from the docking station to the valve rather than from the valve back to the surface of the well. In this manner, the valve may be run into the well without the usual string of control lines therebehind. After drilling, the deployment valve 30 can be remotely closed to control production from the well.

Figure 23:
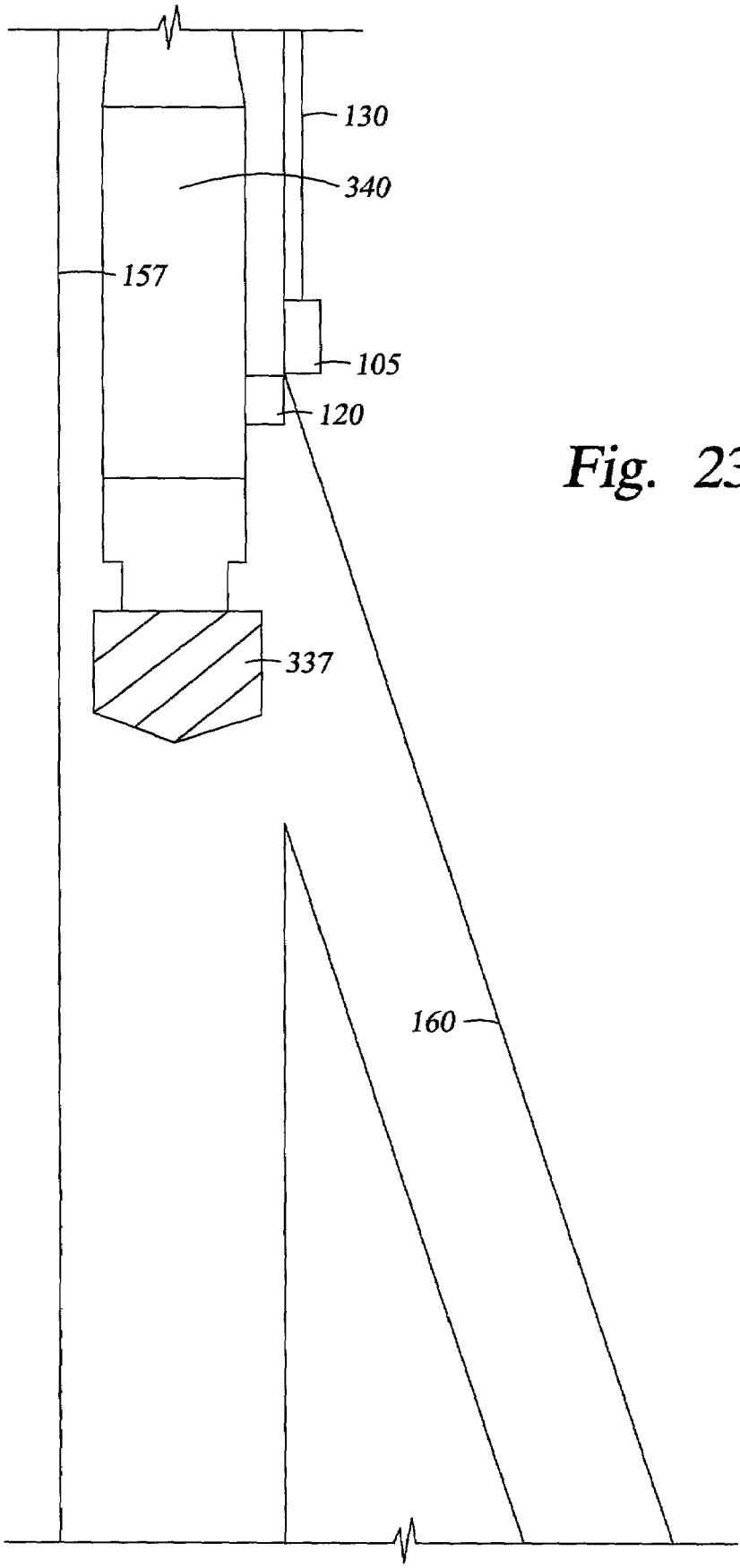
FIG. 23 is a cross section of a wellbore and a lateral wellbore and including a mud motor and a drill bit.

FIG. 23 is a cross-section of a cased wellbore 157 and a lateral wellbore 160 extending therefrom. A docking station 105 is disposed on the outside of the central wellbore casing and a connector assembly 120 is shown on an exterior of a drill string 335 disposed in the central wellbore 157. At a lower end of the drill string is a drill bit 337 and thereabove a mud motor 340 to provide rotational force to the drill bit. In this embodiment, the docking station is used to monitor and diagnose the operation of a downhole component, in this case drilling components like the bit and the mud motor. As an example, the mud motor can include a connector assembly thereon that can be coupled to and placed in fluid communication with the docking station. A power/control line 130 extends from the docking station 105 to the surface of the well. By connecting the component to the docking station, the operational characteristics of the component may be diagnosed by personnel and equipment at the surface of the well.

In operation, a component can be selectively connected to the docking station and diagnostics can then be carried out on the component. Using diagnostic equipment to perform diagnostic functions in a non-intrusive manner, the component can be operated and data transmitted to a remote device and relayed to the surface of the well to be evaluated. The docking station can also be used to transmit data collected from components equipped with sensors to evaluate the conditions in which the components are encountering in the wellbore.

The advantages of using the docking station for diagnostic purposes include the capability of monitoring conditions of wellbore components in the wellbore rather than bringing them to the surface of the well. By evaluating wellbore components in situ, faulty equipment can be removed or replaced prior to break down and operational adjustments may be made to extend the life of the components. The invention may be practiced not only with the components shown, but any component may be coupled to the docking station in order to run diagnostic tests or transmit sensor readings to the surface of the well.

Figure 24:
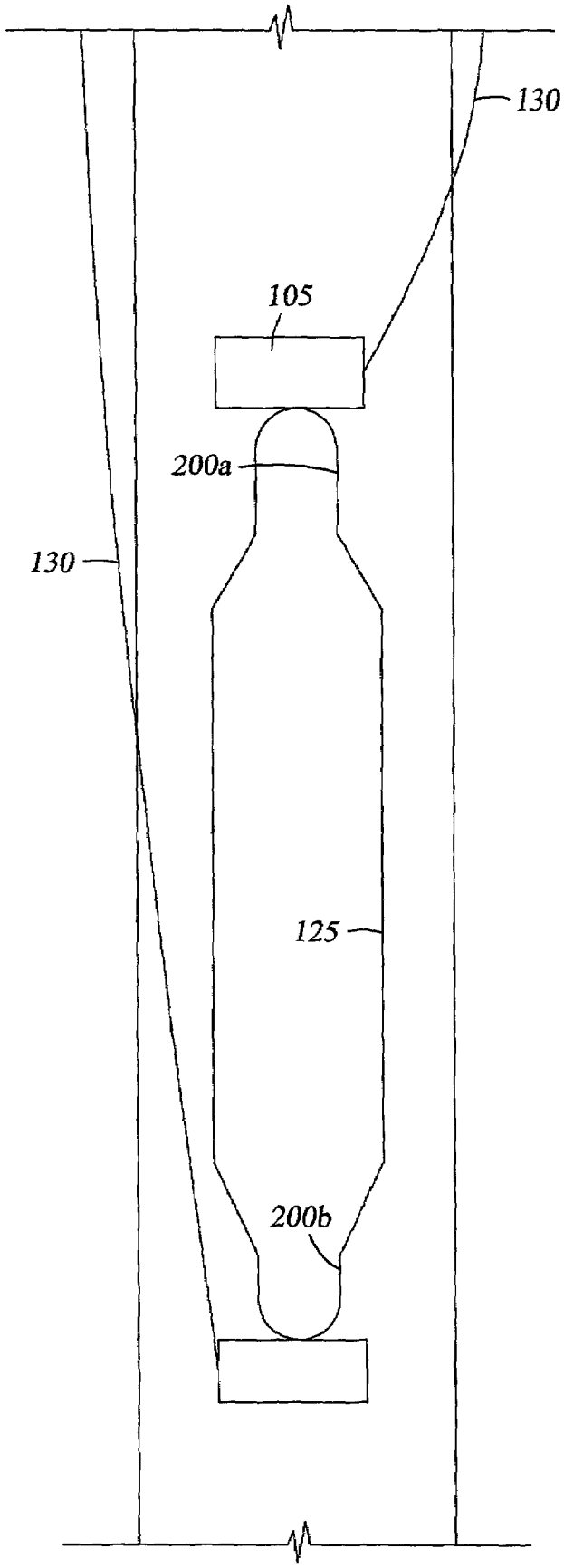
FIG. 24 is a section view of a wellbore with casing having dual key-ways and dual docking stations.

FIG. 24 is sectional view of a wellbore 157 with casing (not shown) disposed in the wellbore with a window 125 formed in a wall of the casing. In the embodiment of FIG. 24, the window 125 includes an upper 200*a* and a lower 200*b* key ways. Adjacent each key way is a docking station 105 located on the exterior of the casing. Each docking station is connected to the surface of the well via power/control lines 130. With dual key ways and dual docking stations, the invention provides a remote connection means for power and control that is more flexible and/or had additional capacity. For example, the design of FIG. 24 permits two connectors to be utilized in a wellbore and connected to the same window. Alternately, the docking station can provide greater flexibility and a choice of docking locations for a single connector.

Figure 25:
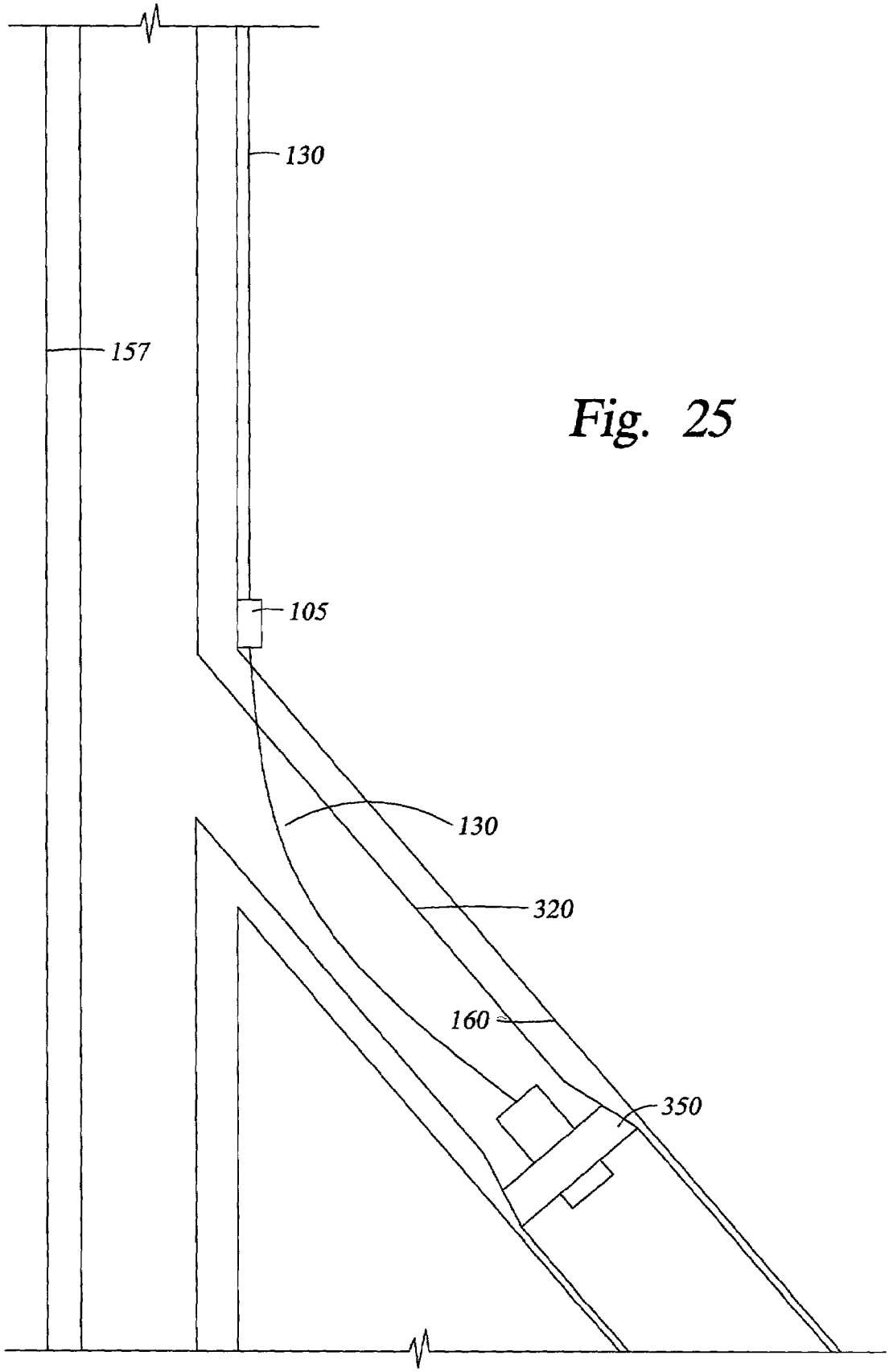
FIG. 25 is a section view of a central and lateral wellbores in which the lateral wellbore includes liner which is expanded through the use of an expander tool.

FIG. 25 is a section view of a central wellbore 157 with a lateral wellbore 160 extending therefrom. Both wellbores 157, 160 are lined with casing (not shown) and a docking station 105 is disposed on the exterior of the casing of the central wellbore adjacent a window formed in the casing of the central wellbore from which the lateral wellbore extends. Also depicted is tubing, or liner 320 extending from the central wellbore into the lateral wellbore. As depicted in the figure, the liner 320 in the lateral wellbore is expanded through the use of an expander tool 350 which is typically run into the wellbore on a separate string of tubulars (not shown) and operated with pressurized fluid supplied from the surface of the well through the tubular string. A power line or control line 130 extends between the docking station and the expander tool 350. Additional power or control lines 130 extend from the docking station to the surface of the well.

The docking station 105 can be used to power the expander tool 350 to cause the upper end of the liner 320 to expand to a diameter equal to the inside diameter of the casing at that location or to even to create a seal out of the liner. In one example, a key on the upper end of the liner or a liner running tool is landed in a key-way adjacent the docking station and power/control is thereafter transmitted from the surface of the well to the expander tool 350. Downhole expansion tools may use either rotary or axial forces or a combination thereof to impart the necessary force required to expand the liner 320. The liner can also be expanded in the area of the casing window whereby the junction between the main and lateral wellbore is substantially sealed to the flow of fluids on the outside of the liner.

The docking station can be utilized to land an outwardly biased key or lug on a string of liners disposed within the casing. By attaching the liner to the casing wall, control devices may be mounted to the liner on the surface or manufactured as part of the liner. Once a connection is established with the control devices in the liner, these devices can be controlled from the surface using the control lines which extend from the docking station to the surface of the well along the outside surface of the casing. In this manner, production from lateral wellbores can be controlled from the surface more easily and in a more cost effective matter since an established control line is available. Additionally intervention or work to correct water influx or other problems associated with lateral wellbores can be minimized. Further, production from laterals can be shut off or increased from the surface quickly and reliably since control to downhole valves is effectively performed by the docking station. Finally, there is an expandable capability and functionality in the control devices due to the capability of mounting the devices in the liner on the surface of the well.

Figure 26:
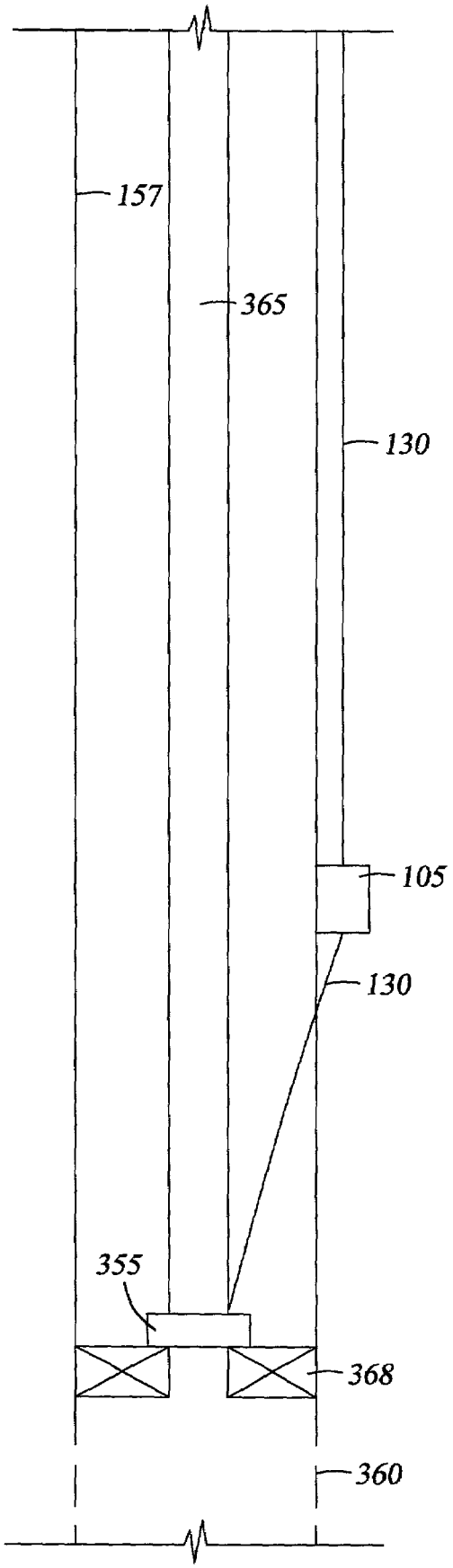
FIG. 26 is a section view of a wellbore and docking station in use with a gas lift control valve.

FIG. 26 is a cross-section view of a wellbore 157 including a docking station of the present invention in use with a gas lift control valve 355. The wellbore includes a casing having a docking station 105 disposed on an outer surface thereof adjacent a key way formed at the upper end of a casing window 125 (not shown). In this instance, the key-way provides a means of aligning and locating a connector with respect to a socket on the docking station. The casing typically includes perforations 360 at a lower end thereof. Production tubing 365 having the gas lift control valve 510 at a lower end is disposed in the wellbore 157. Packer 368 is used to isolate a section of the wellbore in order to urge production fluid into the tubing 365. Control line 130 and a gas line 370 are extend from the valve to the surface of the well via a connection at the docking station 105. The control and gas lines allow an operator to communicate and deliver gas to the valve 355 as the well is in operation.

In use, the casing having the docking station and key-way disposed thereon is inserted and cemented into the wellbore. The production tubing having the gas lift control valve at a lower end is thereafter inserted into the casing and a connector as the tubing string is connected to a socket with the docking station. Thereafter, control signals and a source of gas are transmitted through a control line and a gas line to the docking station. The docking station then transmits the control signals and gas supply to the gas lift control valve control and gas lines running between the docking station and the valve. The gas mixes with the produced fluids and lightens the flow stream in the production tubing. By lightening the fluids in the production tubing with the gas, the pressure in the tubing is reduced relative to the annulus, thereby allowing fluid to more readily enter the tubing and be transported to the surface.

The current invention may also be utilized with conventional gas lift operations. In conventional gas lift operations, gas is injected from the surface of a well into a casing annulus and enters the production tubing through a gas lift control valve located near the bottom of the tubing. In this embodiment, only control lines are used with the docking station.

Figure 27:
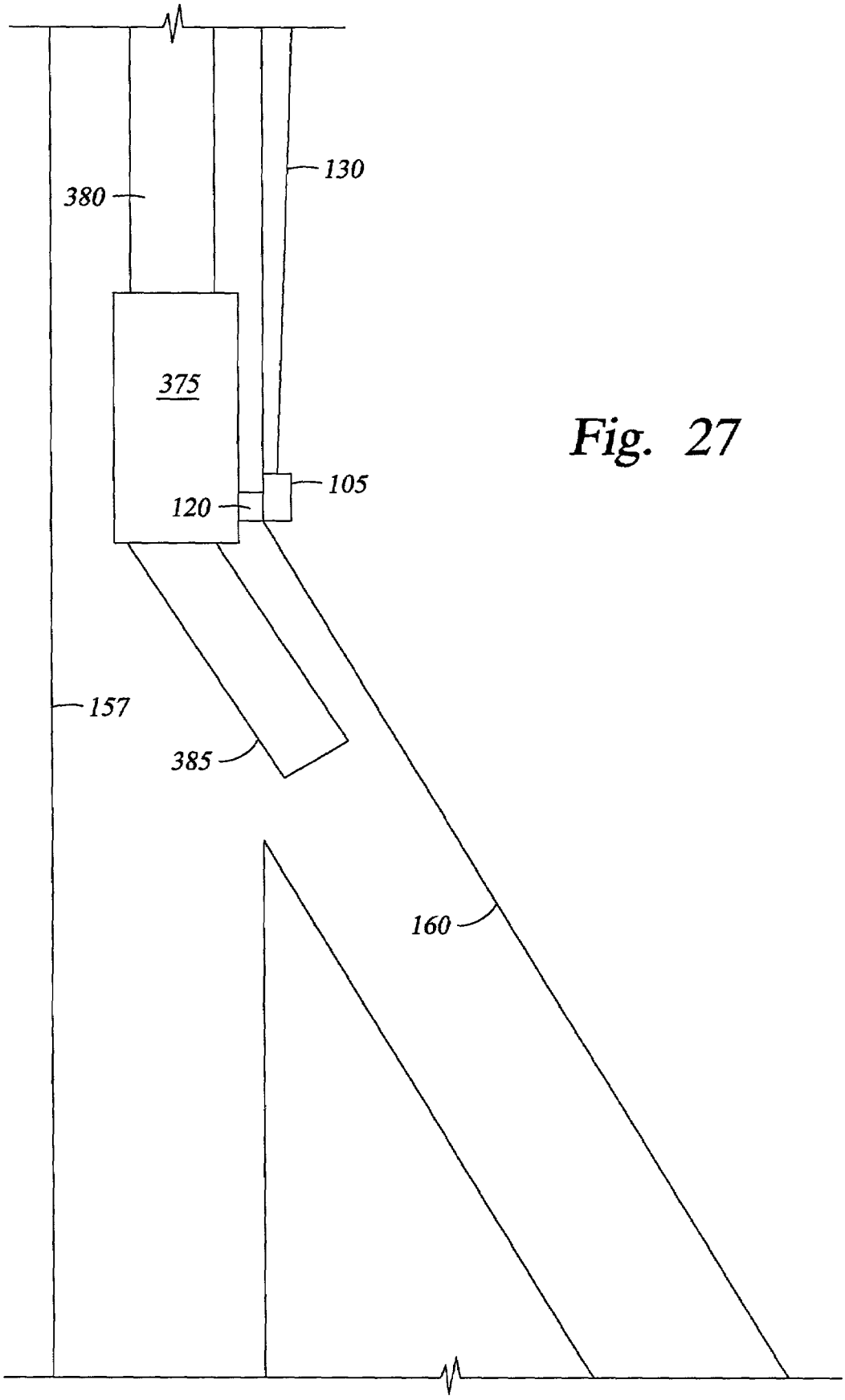
FIG. 27 is a section view of a well including a central and lateral wellbore and an indexing tool in use with a docking station.

FIG. 27 is a section view of a well including a central 157 and a lateral wellbore 160. The central wellbore includes an indexing tool 375 disposed on a run-in string of tubulars 380, the indexing tool including an indexing member 385 shown at an angle of alignment along the centerline of the lateral wellbore. Typically, indexing tools are used to direct other tools to an angle relative to the angle of a central wellbore. For example, indexing tools can be used to direct drill bits towards a lateral wellbore. In this manner, the central wellbore can be utilized to run in a tool and thereafter, using the indexing tool, the tool can be directed from the axial centerline of the central wellbore to a predetermined angle. Disposed on the exterior of the casing of the central wellbore is a docking station 105 which is permanently attached thereto adjacent a key-way typically formed at an upper end of a window in the casing. A power/control line 130 extends from the docking station 105 to the surface of the well on the exterior of the casing wall. The indexing tool 375 includes, on an outer surface thereof, a connector assembly 120 which is constructed and arranged to extend through the key-way formed below the docking station whereby the connector assembly will be connected to a socket within the docking station 105 and the indexing tool 375 will thereby be provided with power and control means from the surface of the well. Alternatively, the connector could be located anywhere on the run-in string allowing placement of the connector adjacent a docking station and key-way.

In operation, the indexing tool 375 is run into a wellbore 157 on a string of tubulars 380. The wellbore is previously fitted with casing having a key-way therein and docking station 105 disposed adjacent the key-way. By manipulation of the string 380 from the surface of the well, the connector is located in the key-way and is connected to a socket within the docking station. Thereafter, the indexing tool 375 can be adjusted and otherwise controlled and operated from the surface of the well.

Figure 28:
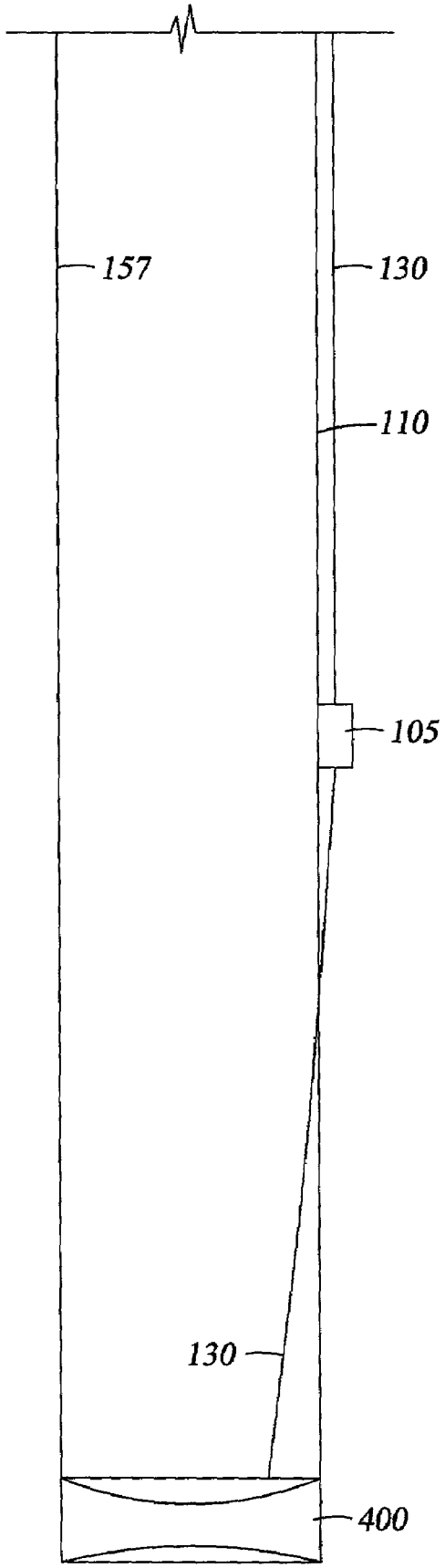
FIG. 28 is a cross section view of a wellbore with a docking station in use with an auto fill valve.

FIG. 28 is a cross-section view of a wellbore including a docking station of the present invention in use with an auto fill valve 400. The wellbore 157 includes a tubular 110 having the docking station 105 disposed on an outer surface thereof and an auto fill valve 400 at a lower end of the casing. An aperture formed in the casing wall is adjacent the docking station 105. Central/power line 130 extends from the surface of the well to the docking station 105. An additional control/power line 130 runs between the valve 400 and a connector assembly 120. Using the docking station, the auto fill valve 400 can be opened or closed remotely from the surface of the well.

An auto fill valve 400 is utilized during casing installation operations to allow the casing to partially fill up with wellbore fluid during run in. During run in of the casing, the auto fill valve is operated in an open position, thereby allowing fluid to enter the casing string in order to prevent pressure surges that can damage oil-bearing formations. Later, after the cement has been circulated from the casing to an annulus between the casing and the borehole therearound, the auto fill valve 400 is remotely closed to prevent the cement from reentering the casing. After the casing installation is complete, the auto fill valve can be retrieved or can be destroyed by a drill bit. The docking station 105 can be further utilized and docked with additional wellbore components as needed. Using the docking station, the valve can be opened or closed as often as necessary rather than relying upon fluid movement or pressure to change the position of the valve.

Figure 29:
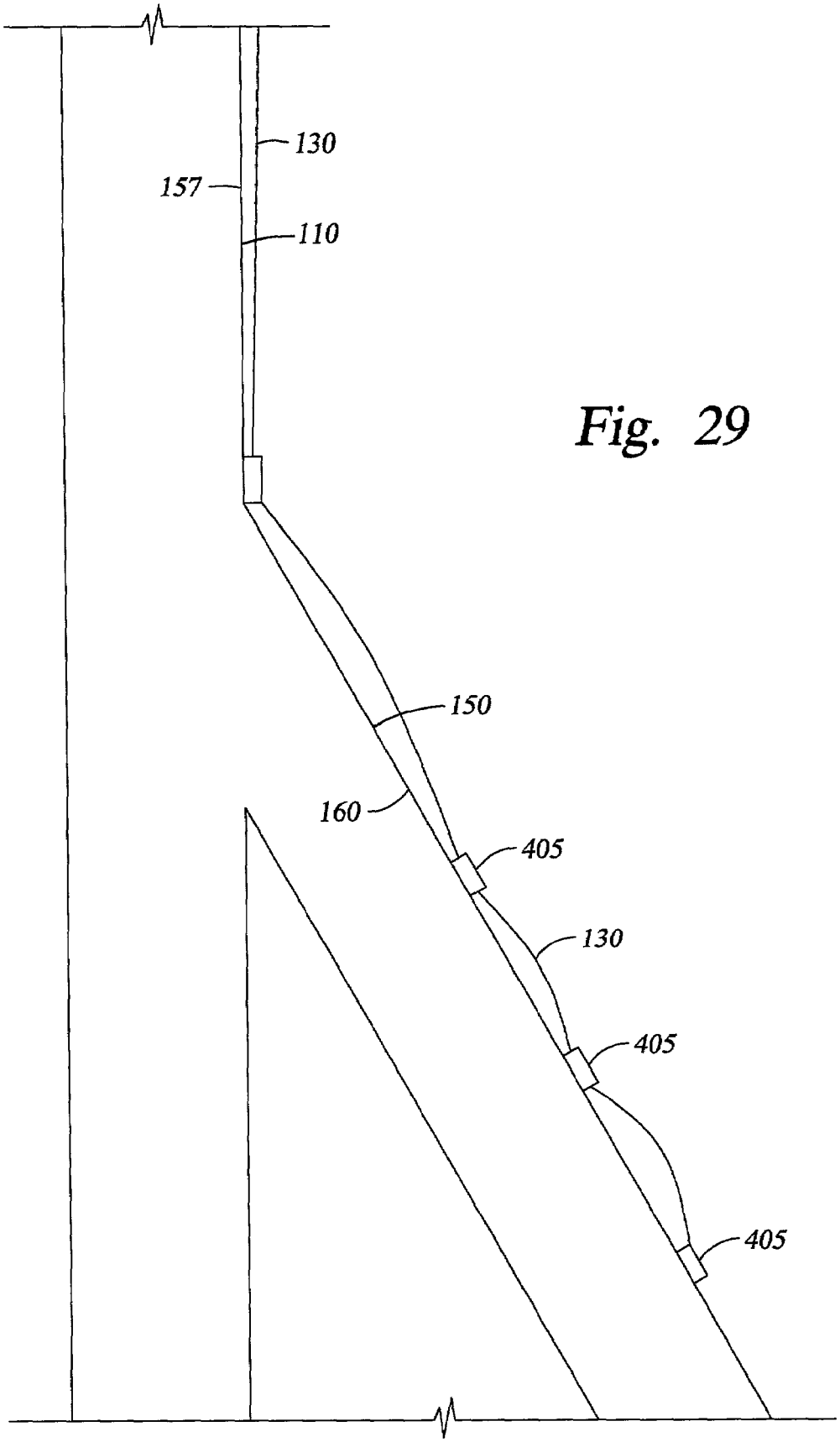
FIG. 29 is a cross section of a wellbore including a casing, a lateral wellbore and a docking station in use with seismic sensors.

FIG. 29 is a cross-section of wellbore 157 including a tubular 110, a lateral wellbore 160 with liner 150, and a docking station 105 of the current invention in use with seismic sensors 405. The docking station 105 is disposed on the outer wall of tubular 110 and is adjacent a pre-milled window. Seismic sensors 405 are shown disposed on the outside of the lateral wellbore liner 150. Monitoring line 130 extends from the surface of the well to the docking station on the exterior of the tubular 110. Control/power lines 130 run from the docking station 105 to the seismic sensors 405. Collectively, control/power lines 130 collect and relay data to the docking station 105, which relays the data to the surface of the well via control/power lines 130.

In use, the lateral is formed by drilling through a window formed in a wall of the casing. Thereafter, a liner is run into the lateral wellbore with seismic sensors disposed on the outer surface thereof. Typically the sensors are built in a robust housing to resist damage as the liner is run into the wellbore and later lined with casing. The seismic sensors can be placed at intervals along the central casing and the cased lateral to gather data related to seismic activity in the wellbore. The sensors communicate with the surface via the docking station and control/power lines 130.

Figure 30:
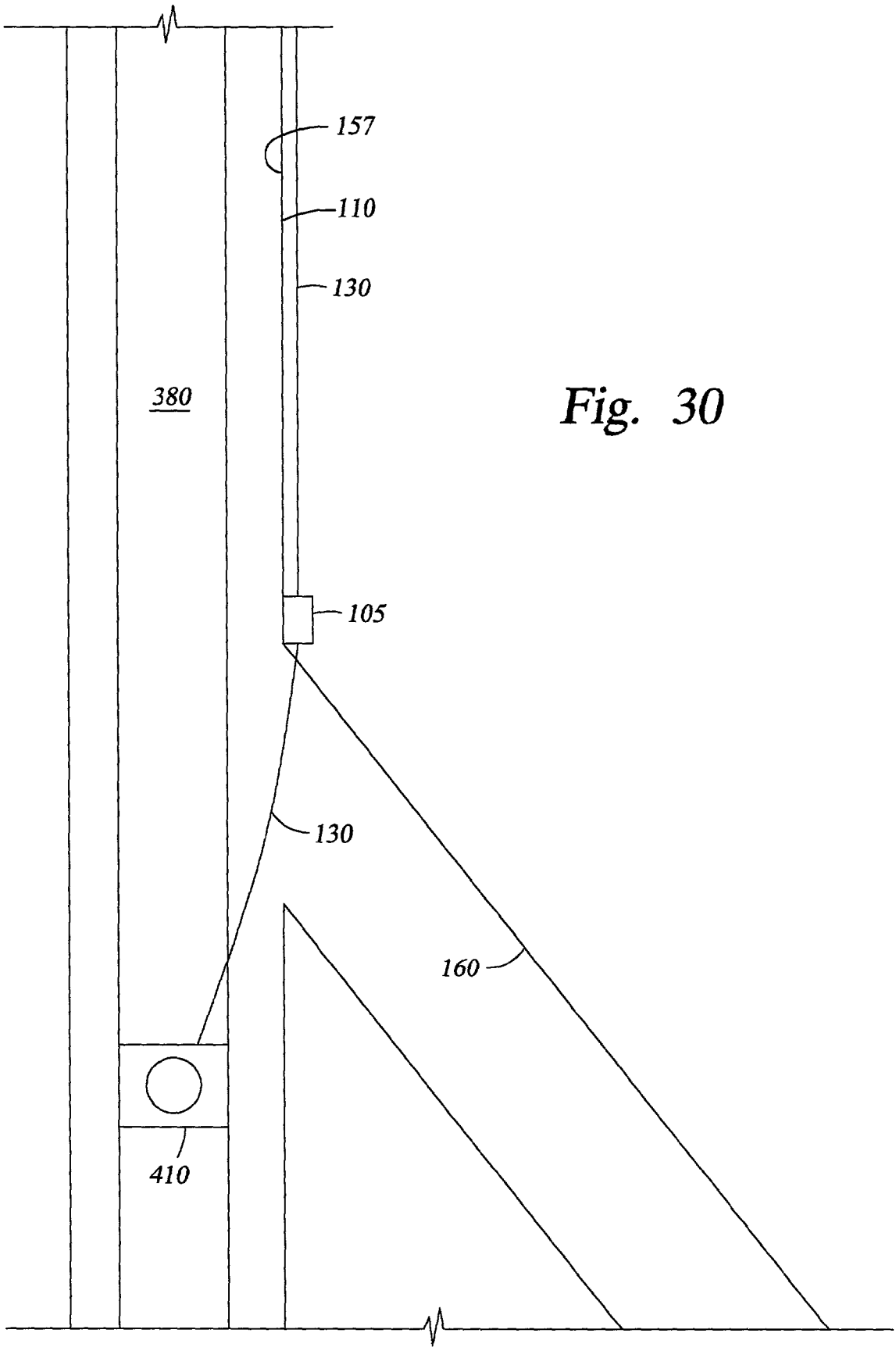
FIG. 30 is a section view of a wellbore and a lateral wellbore and an electrical component in use with a docking station.

FIG. 30 is a section view of a central wellbore 157 and a lateral wellbore 160 extending therefrom. The central wellbore 157 is equipped with a tubular string 380 coaxially disposed therein and is lined with tubular 110 therearound. The docking station 105 of the present invention is disposed on the outside of the casing and power/control line 130 extends from the docking station to the surface of the well along the exterior of the casing wall. In FIG. 30, an electric component, namely a motor 410 is disposed in the tubular string 380. Also depicted in the figure is another control/power line 130 extending from the motor 410 to the docking station 105.

FIG. 30 illustrates a method and apparatus for operating an electric component in a wellbore using the docking station of the present invention. As depicted, the electrical power source is disposed on the outside surface of the tubular 110 and is utilized to power the electrical component on the inside of the casing, in this example the electric motor 410. Typically, the electric motor would be run into the well on the string of tubulars 380 and thereafter a connector assembly (not shown) disposed on the exterior wall of the tubing string would access an aperture formed in the casing, adjacent the docking station 105. In this manner, the connector assembly is electrically connected to the docking station and the electrical component can thereafter be operated in the wellbore without any electrical lines extending to the surface of the well inside of the central wellbore 157. Typically, the connection between the docking station 105 and the connector assembly 120 serves as a link to complete the electrical circuit for power transmission to power devices located in the production tubing, such as an electrically driven pump. The docking station can also direct and control the flow of electrical current to multiple devices. Utilizing this aspect of the invention eliminates the requirement to run electrical cables from the surface of the well to each individual electrical component.

Figure 30A:
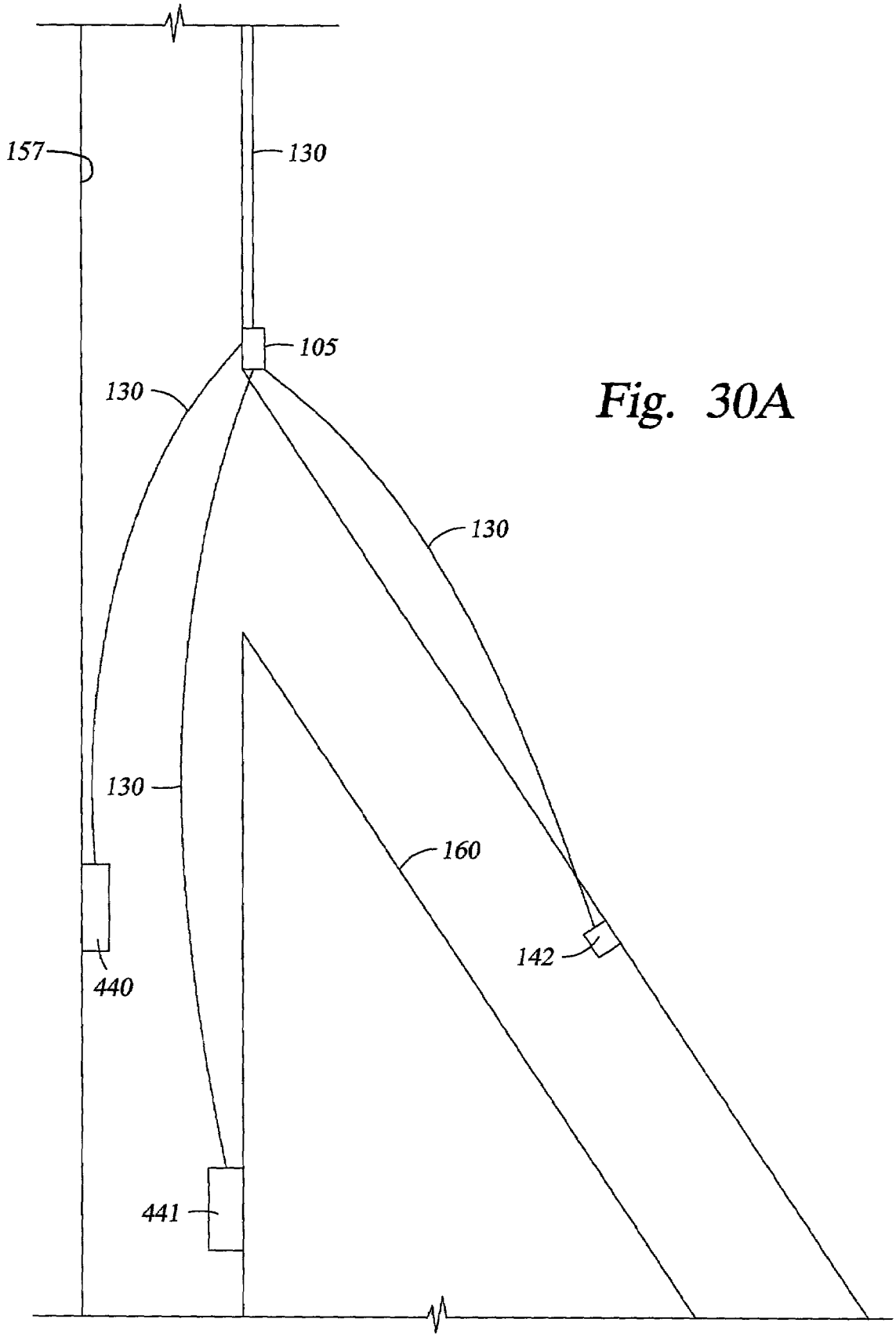
FIG. 30*a* is a section view of a central and lateral wellbores including a docking station in use as a multiplexing device.

FIG. 30A is a section view of a central 157 and lateral 160 wellbores illustrating the docking station 105 in use as a multiplexing device. Disposed in the central wellbore 157 are two components 440, 441 which are connected to the docking station via control/power lines 130. Disposed in the lateral wellbore 160 is a third component 142 also connected to the docking station with a control/power line 130. The docking station is itself connected to the surface of the well with at least one control/power line 130. By having a single source of power and control means at the docking station, the various components 440, 441, 442 can be individually controlled from one downhole location with out the use of individual lines running from the surface of the well to each component. As in previous embodiments, some means of downhole connection between the components and the docking station, like a connector assembly, is utilized.

Figure 31:
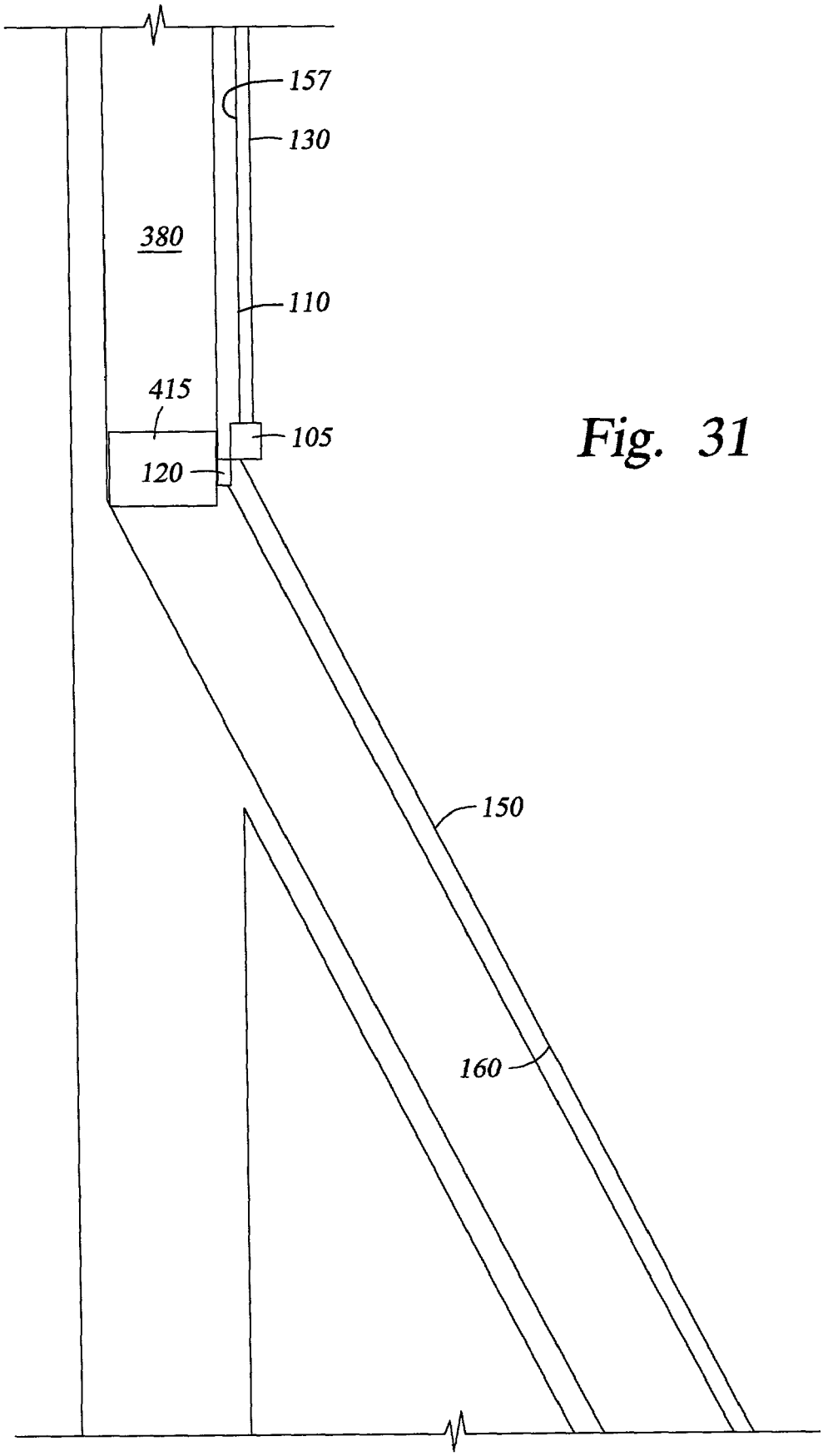
FIG. 31 is a section view of a wellbore having a docking station and a tractor therein.

FIG. 31 is a section view of a well including a central wellbore 157 and a lateral wellbore 160 extending therefrom. Both the central wellbore and lateral wellbores are lined with the tubular 110, which can also be the liner 150 and an additional string of tubing 380 extends from the central wellbore into the lateral wellbore. Disposed above a window (not shown) formed in the central wellbore and located adjacent a key-way formed above the window, is a docking station 105 which is disposed on the outside casing of the central wellbore 157. The docking station includes a control and/or power line 130 which extends from the docking station to the surface of the well along the outside wall of the tubular 110. Shown inside the central wellbore and run in on the separate string of tubulars 300 is a tractor 415. The tractor provides axial movement of components in a wellbore and operates with a source of pressurized fluid, typically supplied by the run-in string of tubulars 360 upon which the tractor is run. In FIG. 31, a connector assembly 120 extends from the tractor 415 to the docking station 105. Typically, the tractor 415 would be provided with a connector assembly 120 disposed on the exterior thereof. The connector assembly 120, when extended through the key-way (not shown) formed adjacent the docking station 105 permits the tractor 415 to be directly connected to the docking station. In this manner, the docking station can be utilized to deliver power to a rechargeable tractor or to receive data from the tractor collected while the tractor is in use. In one example, the tractor can be landed in a profile some distance from the docking station and connected to or controlled by the docking station via control/power lines 130. By utilizing the docking station in this manner, information can be downloaded from the tractor 415 without removing the tractor from the wellbore. Additionally, rechargeable means on the tractor, like batteries can be recharged without the tool being removed from the wellbore, thereby saving operation costs and time.

Figure 32:
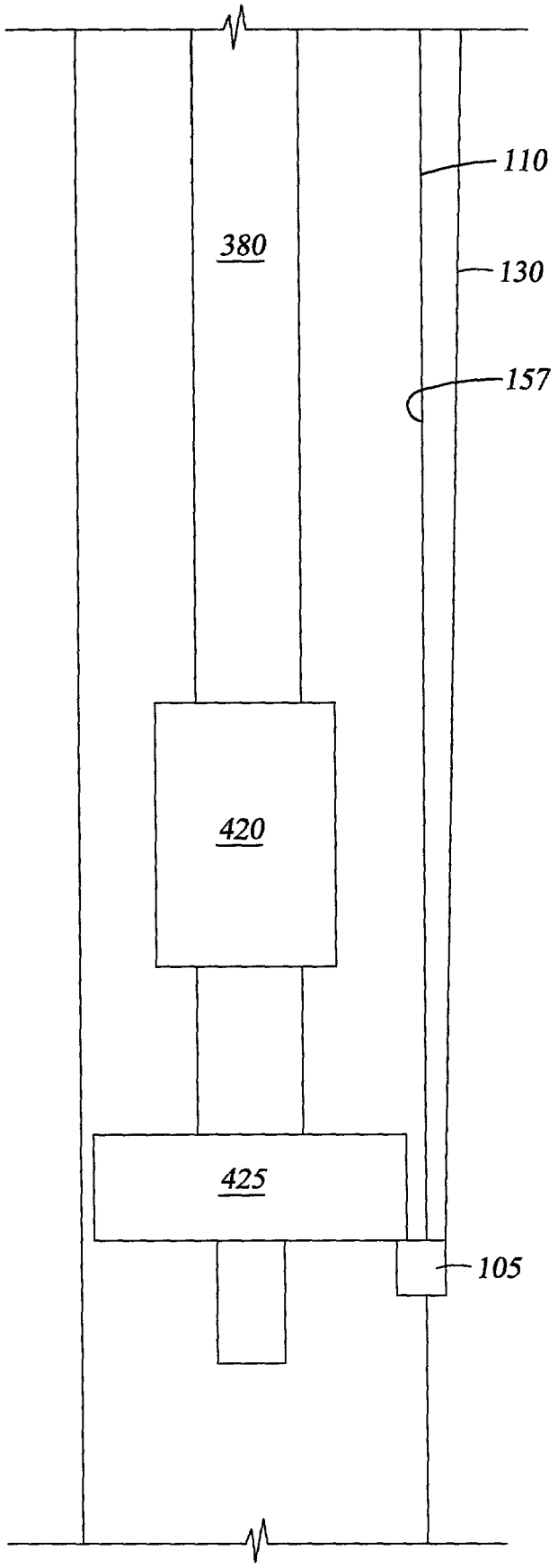
FIG. 32 is a section view of a wellbore having a docking station in use with an electrical submersible pump.

FIG. 32 is a cross-section of a wellbore 157 including tubular 110, and a docking station 105 in use with an electric submersible pump 420 disposed on a string of tubulars 380 in the wellbore 157. The tubular 110 includes a pre-milled window (not shown) adjacent the docking station 105. An electric motor 425 including a connector assembly (not shown) is connected to the docking station through the pre-milled window. By coupling with the docking station, power and control signals from the surface can be relayed to the electrical motor via power/control line 130 extending from the docking station to the surface of the well.

Figure 33:
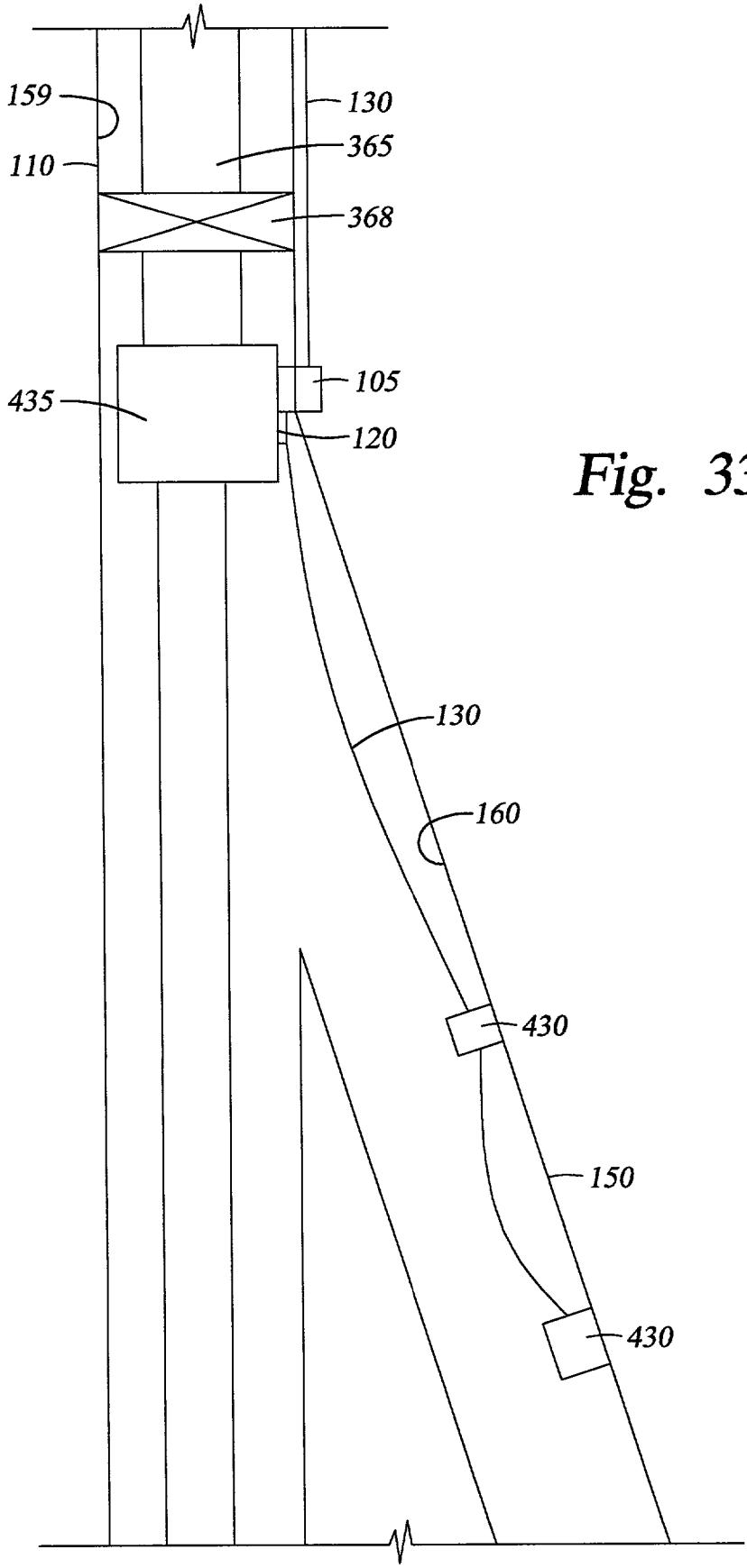
FIG. 33 is a section view illustrating a docking station in use with monitoring devices.

FIG. 33 is a section view illustrating the docking station assembly 100 of the present invention used with monitoring devices. A central wellbore 157 is lined with tubular 110 and includes a string of production tubing 365 extending therethrough. A packer 368 seals an annular area between the tubular 110 and the production tubing 365. The tubular 110 includes a docking station 105 disposed adjacent a window formed in the casing through which a lateral wellbore 160 extends. The lateral wellbore is also lined with liner 150 which includes, on the interior thereof, monitoring devices 430 which are spaced apart and linked together electronically via control/power lines 130. The monitoring devices are also linked directly to a monitoring component 435 which is run into the well on the production tubing 365 and includes logic and control for the monitoring devices. Alternatively, the monitoring component 435 could be located at the surface of the well. Utilizing the docking station 105 formed on the exterior of the tubular 110 and the connector assembly 120, which is run into the wellbore along with or separately from the monitoring component, control and power are provided to the monitoring component 435 and the monitoring devices 430.

Additionally, the docking station provides signaling means from the monitoring devices back to the surface of the well via control/power lines 130 which extend from the docking station to the surface of the well along the outside of the casing. Utilizing the docking station and connector assembly of the present invention, a monitoring component may be run into a wellbore and remotely supplied with power and control means without the need for power and control lines to be transported into the wellbore with the monitoring component. Additionally, multiple components can be controlled and powered from a single docking station.

In use, a central wellbore 157 is formed and lined with tubular 110 that either includes a pre-milled window with a key-way at an upper end of the window or the window and key-way are formed in the casing of the central wellbore after it is installed and cemented into a borehole. In either case, the casing is provided with a docking station 105 disposed on an external surface thereof constructed and arranged to be adjacent the key-way. At a later time, the monitoring component 435 is run into the wellbore on a separate string of tubulars 365 and an outwardly extending connector assembly 120 on the monitoring component is joined with the docking station 105 by manipulation from the surface of the well. As the components are joined together, the monitoring component is supplied with control and power means and the monitoring devices which are disposed on the interior of a newly formed lateral wellbore are operational. Alternatively, the apparatus, including the docking station and components can be used in a single, central wellbore.

In addition to facilitating the connection between a docking station and a connector, the upper key-way (not shown) of the window formed in casing wall can be used to anchor and absorb reactive torque or to prevent axial forces from moving a tubing string. For example, with a key landed in a key-way of the window, an upward force can be applied to pull the tubing into tension in order to facilitate the operation of production equipment. The advantages of using the docking station to anchor the production tubing include eliminating the need for a tubing anchor or other devices to prevent rotation or axial movement of production string that may result from the operation of production equipment. Additionally, the production tubing string can be landed in tension thereby bypassing some steps and saving time.

While the foregoing is directed to the preferred embodiment of the present invention, other and further embodiments of the invention may be devised without departing from the basic scope thereof, and the scope thereof is determined by the claims that follow.

The invention claimed is:

1. A system for communicating between the surface of a well and a component in a wellbore, comprising:

a first tubular having an aperture in a wall thereof;

a connector disposed on an outside surface of the tubular proximate the aperture, the connector including a first line extending from the connector toward the surface of the well;

a second tubular at least partially disposed co-axially within the first tubular, the second tubular having a mating connector disposed on a surface thereof and a second line extending between the mating connector and the component, the connector and the mating connector constructed and arranged to mate via the aperture in the first tubular, thereby establishing a direct line between the component and the surface of the well.

2. The system of claim 1, wherein the component is at least one injection port and is selectively openable and closeable remotely.

3. The system of claim 1, wherein the component is a control device, operable from the surface of the well, the control device controlling at least one other component in the wellbore.

4. The system of claim 1, wherein the component is a controllable profile disposed in an interior of the first tubular, the profile adjustable for receiving at least one other component disposable in the wellbore.

5. The system of claim 1, wherein the component is a deployment valve, the valve selectively moved between an open and closed position.

6. The system of claim 1, wherein the component is a mud motor operated and monitored from the surface of the well and includes sensors to measure.

7. The system of claim 1, wherein the component is operated and monitored from the surface of the well and includes sensors to measure and communicate down hole conditions to the surface of the well.

8. The system of claim 1, wherein the component is an expander tool constructed and arranged to enlarge an inner diameter of a tubular.

9. The system of claim 1, wherein the component is a gas lip control valve disposal at a predetermined location in a string of production tubing.

10. The system of claim 1, wherein the component is an indexing tool disposed on a run in string of tubulars, the indexing tool adjustable from the surface of the well.

11. The system of claim 1, wherein the component is an auto filled valve disposed at a lower end of a tubular coaxially disposed within the first tubular.

12. The system of claim 1, wherein the component is at least one sensor disposed along the first and second tubulars, the sensors communicating wellbore conditions to the surface of the well.

13. The system of claim 1, wherein the component is an electrical component and the component is powered from the surface of the well.

14. The system of claim 1, wherein the component is a rechargeable component.

15. The system of claim 1, further comprising an alignment structure on the first tubular and a mating alignment structure disposed on the exterior of the second tubular to facilitate mating of the connector and mating connector.

16. The system of claim 12, wherein the sensors are seismic sensors.

17. The system of claim 13, wherein the electrical component includes a down hole pump.

18. The system of claim 14, wherein the rechargeable component is a wellbore tractor.

19. A system for communicating between a first location in a well and a second location in a well, comprising:

a first tubular having an aperture in a wall thereof;

a connector disposed on a surface of the tubular proximate the aperture, the connector including a first line extending from the connector toward the first location in the well;

a second tubular at least partially disposed adjacent the first tubular, the second tubular having a mating connector disposed on a surface thereof and a second line extending between the mating connector and the second location which is a component, the connector and the mating connector constructed and arranged to mate via the aperture in the first tubular, thereby establishing a direct line between the second location and the first location;

a key and key-way arrangement including a key disposed on the exterior of the second tubular, the key constructed and arranged to become located in a key-way formed in the aperture to rotationally and axially locate the second tubular with respect to the first tubular; and the connector of the first tubular is enclosed in an enlarged diameter portion of the tubular and is substantially isolated from the exterior of the first tubular.

20. The system of claim 19 wherein the first and second lines are power lines.

21. The system of claim 19 wherein the first and second lines are fluid control lines.

22. The system of claim 21 wherein the connector of the first tubular includes a male portion and the mating connector includes a socket.

23. The system of claim 22 wherein the key of the first tubular is outwardly biased.

24. The system of claim 23 wherein the aperture is a window and the second tubular extends from the interior of the first tubular through the window and into a lateral wellbore extending from the window.

25. The system of claim 24 wherein the window includes at least one key-way formed at an upper end thereof, the key-way constructed and arranged to receive the spring loaded key.

26. The system of claim 25 wherein locating the key in the key-way causes the male portion to mate with the socket.

27. The system of claim 26 wherein the first tubular is casing lining a central wellbore and cemented therein.

28. The system of claim 27 wherein the second tubular is a liner for lining a lateral wellbore extending from the window formed in the casing.

29. The system of claim 28 wherein the second tubular is a tubular string coaxially disposed in the casing.

30. A system for communicating between a first location in a well and a second location in a well, wherein the second location is a component comprising:

a first tubular having an aperture in a wall thereof;

a connector disposed on an outside surface of the tubular proximate the aperture;

a second tubular at least partially co-axially disposable within the first tubular, the second tubular having a mating connector disposed on a surface thereof, the connector and the mating connector constructed and arranged to mate via the aperture in the first tubular;

an alignment structure on the first tubular and a mating alignment structure disposed on the exterior of the second tubular to facilitate mating of the connector and mating connector, wherein the alignment and mating alignment structure comprise a key and key-way arrangement including a key disposed on the second tubular, the key constructed and arranged to become located in a key-way formed in the aperture to rotationally and axially locate the second tubular with respect to the first tubular.

31. The system of claim 30, wherein the connector of the first tubular is enclosed in an enlarged portion of the tubular and is substantially isolated from the exterior of the first tubular.

32. The system of claim 31, wherein the key of the first tubular is outwardly biased.

33. The system of claim 32, wherein the aperture is a window and the second tubular extends from the interior of the first tubular through the window and into a lateral wellbore extending from the window.

34. The system of claim 33, wherein the window includes at least one key-way formed at an upper end thereof, the key-way constructed and arranged to receive the spring loaded key.

35. The system of claim 34, wherein locating the key in the key-way causes the connector to mate with the mating connector.

36. The system of claim 33, wherein the component is a control valve disposed across and selectively sealing a flow path through the second tubular in an area of the tubular adjacent the window.

37. The system of claim 33, wherein there is at least one component in the first tubular and at least one component in the second tubular, all components communicating with the surface of the well.

38. The system of claim 33, wherein the component is at least one monitoring device extending along the lateral wellbore, the monitoring device transmitting information to the surface of the well.

39. The system of claim 38, wherein the at least one monitoring device communicates with a control device adjacent the window and the control device transmits information to the surface of the well.

40. The system of claim 34, wherein there is a key-way at an upper and lower ends of the window and a connector adjacent each key-way.

41. A system for communicating between a first location in a well and a second location in a well, comprising:

a first tubular having an aperture in a wall thereof;

a connector disposed on an outside surface of the tubular proximate the aperture, wherein the connector includes a first line extending from the connector toward the first location in the well;

a second tubular at least partially co-axially disposable within the first tubular, the second tubular having a mating connector disposed on a surface thereof, and a second line extending between the mating connector and the second location, the connector and the mating connector constructed and arranged to mate via the aperture in the first tubular, thereby establishing a direct line between the second location and the first location.

* * * * *

UNITED STATES PATENT AND TRADEMARK OFFICE

CERTIFICATE OF CORRECTION

PATENT NO. : 7,063,143 B2
APPLICATION NO. : 10/013189
DATED : June 20, 2006
INVENTOR(S) : Tilton et al.

It is certified that error appears in the above-identified patent and that said Letters Patent is hereby corrected as shown below:

Column 19, Claim 6, Line 60: Delete “and includes sensors to measure”.

Signed and Sealed this

Fifth Day of December, 2006

JON W. DUDAS
*Director of the United States Patent and Trademark Office*